US006165350A

United States Patent [19]

Lokhandwala et al.

[11] Patent Number: 6,165,350

[45] **Date of Patent: *Dec. 26, 2000**

[54] SELECTIVE PURGE FOR CATALYTIC REFORMER RECYCLE LOOP

[75] Inventors: Kaaeid A. Lokhandwala, Union City; Richard W. Baker, Palo Alto, both of Calif.

[73] Assignee: Membrane Technology and Research, Inc., Menlo Park, Calif.

[ * ] Notice: This patent is subject to a terminal disclaimer.

[21] Appl. No.: 09/083,653

[22] Filed: May 22, 1998

[51] Int. Cl.[7] ..... C10G 35/00

[52] U.S. Cl. ..... 208/103; 208/100; 208/101; 208/102; 208/133; 585/818

[58] Field of Search ..... 208/100, 101, 208/102, 103, 133; 585/818

[56] References Cited

U.S. PATENT DOCUMENTS

| | | | |
|---|---|---|---|
| 3,431,195 | 3/1969 | Storch et al. | 208/101 |
| 3,520,800 | 7/1970 | Forbes | 208/101 |
| 4,362,613 | 12/1982 | MacLean | 208/108 |
| 4,364,820 | 12/1982 | DeGraff et al. | 208/101 |
| 4,367,135 | 1/1983 | Posey, Jr. | 208/108 |
| 4,370,150 | 1/1983 | Fenstermaker | 55/16 |
| 4,457,834 | 7/1984 | Caspers et al. | 208/143 |
| 4,548,619 | 10/1985 | Steacy | 55/16 |
| 4,645,063 | 2/1987 | Auvil et al. | 62/18 |
| 4,836,833 | 6/1989 | Nicholas et al. | 55/16 |
| 4,842,718 | 6/1989 | Luteijn et al. | 208/308 |
| 4,857,078 | 8/1989 | Watler | 55/16 |
| 4,892,564 | 1/1990 | Cooley | 55/16 |
| 5,053,067 | 10/1991 | Chretien | 62/24 |
| 5,082,481 | 1/1992 | Barchas et al. | 62/23 |
| 5,082,551 | 1/1992 | Reynolds et al. | 208/100 |
| 5,089,033 | 2/1992 | Wijmans | 55/19 |
| 5,157,200 | 10/1992 | Mikkinen et al. | 585/803 |
| 5,199,962 | 4/1993 | Wijmans | 55/16 |
| 5,205,843 | 4/1993 | Kaschemekat et al. | 55/16 |
| 5,211,838 | 5/1993 | Straubs et al. | 208/65 |
| 5,332,424 | 7/1994 | Rao et al. | 95/47 |
| 5,332,492 | 7/1994 | Maurer et al. | 208/340 |
| 5,354,547 | 10/1994 | Rao et al. | 423/650 |
| 5,374,300 | 12/1994 | Kaschemekat et al. | 95/39 |
| 5,435,836 | 7/1995 | Anand et al. | 95/45 |
| 5,447,559 | 9/1995 | Rao et al. | 423/650 |
| 5,507,856 | 4/1996 | Rao et al. | 95/50 |
| 5,634,354 | 6/1997 | Howard et al. | 62/624 |
| 5,689,032 | 11/1997 | Krause et al. | 585/802 |
| 5,785,739 | 7/1998 | Baker | 95/39 |

OTHER PUBLICATIONS

W.A. Bollinger et al., "Prism™ Separators Optimize Hydrocracker Hydrogen," Paper presented at AIChE 1983 Summer National Meeting, Session No.66, Aug. 29, 1983.

W.A. Bollinger et al., "Optimizing Hydrocracker Hydrogen," Chemical Engineering Progress, p.51–57, May 1984.

J.M. Abrado, et al. "Hydrogen Technologies to Meet Refiners' Future Needs," Hydrocarbon Processing, p. 43–49, Feb. 1995.

H. Yamashiro, et al., "Hydrogen Purification with Cellulose Acetate Membranes," presented at Europe–Japan Congress on Membranes and Membrane Processes, Jun. 18–21, 1984.

H. Yamashiro et al., "Plant Uses Membrane Separation," Hydrocarbon Processing, Feb. 1985.

"Polymeric Gas Separation Membranes," Paul and Yampolski (eds.),–no month.

"Membrane Technology for Hydrocarbon Separation," Membrane Associates Ltd.,–no date.

R.A. Meyers (Ed.) "Handbook of Petroleum Refining Processes", second Edition, Chapter 4. McGraw–Hill, New York (1997) no month.

*Primary Examiner*—Marian C. Knode
*Assistant Examiner*—Nadine Preisch
*Attorney, Agent, or Firm*—J. Farrant

[57] ABSTRACT

Processes and apparatus for providing improved catalytic reforming, specifically improved recovery of reformate and hydrogen from catalytic reformers. The improvement is achieved by passing portions of the reactor effluent or streams derived from the reactor effluent across membranes selective in favor of light hydrocarbons over hydrogen.

38 Claims, 6 Drawing Sheets

SELECTIVE PURGE FOR CATALYTIC REFORMER RECYCLE LOOP

FIELD OF THE INVENTION

The invention relates to improved catalytic reforming, and specifically to improved recovery of reformate and hydrogen from catalytic reformers, by passing effluent gases across hydrocarbon selective membranes.

BACKGROUND OF THE INVENTION

Many operations carried out in refineries and petrochemical plants involve feeding a hydrocarbon/hydrogen stream to a reactor, withdrawing a reactor effluent stream of different hydrocarbon/hydrogen composition, separating the effluent into liquid and vapor portions, and recirculating part of the vapor stream to the reactor, so as to reuse unreacted hydrogen.

Reactions carried out under such a scheme can be divided generally into hydrogen-consuming reactions and hydrogen-producing reactions. The hydrogen-consuming reactions include hydrotreating, hydrocracking and various hydrogenation operations. The hydrogen-producing reactions include reforming and various dehydrogenation operations. Of these, the principal hydrogen producer for the refinery is reforming, and an important aspect of reformer operation is to generate as much hydrogen as possible, consistent with other requirements, of a quality suitable for use in the hydrogen-consuming units, particularly hydrocrackers and hydrotreaters.

The reformer is the unit that provides the octane level needed for the gasoline product of the refinery. The reformer feedstock is straight run naphtha or a naphtha cut from other refinery operations, such as coker naphtha or FCC (fluid catalytic cracking) naphtha. Although the bulk of components in straight run naphtha are paraffins, also present may be naphthenes, aromatics and olefins; non-virgin naphtha stocks tend to be higher in aromatics and olefins. Reforming involves the upgrading of these components by various reactions. The process is generally carried out in three reaction zones, in each of which specific reactions are favored. For example, the first zone may perform, among other reactions, dehydrogenation of methylcyclohexane to toluene (RON 120), the second zone may perform dehydrocyclization of iso-heptane to toluene, and the third zone may perform isomerization of normal to iso-heptane (RON 90), as well as cracking of n-heptane to pentane (RON 90). Although the process is an overall producer of hydrogen, hydrogen is recycled back to the feed to maintain the hydrogen-to-hydrocarbon ratio in the reactors within a range to favor the desired reactions and to prolong the catalyst life. Typically hydrogen:hydrocarbon molar ratios up to about 10:1 are used.

In an ideal situation, no cracking that results in light hydrocarbons would take place, and the only by-product of the reactions would be hydrogen. In practice, this cannot be achieved. Conversion of iso-heptane to toluene and of methylcyclohexane to toluene are both hydrogen-producing reactions, but the cracking reactions result in formation of light hydrocarbon fragments, such as methane, ethane, propane and butanes. These light hydrocarbons contaminate the hydrogen product and may result in over-production of fuel gas. Under some reforming conditions, even more undesirable side reactions can give rise to formation of polycyclic aromatic compounds, some of which can be carried into the recycle gas. The net result is that, in an average refinery, 20,000 bbl of straight run naphtha feedstock may be converted into about 15,000 bbl of reformate and 5,000 bbl of gas, which includes substantial amounts of $C_1$–$C_5$ hydrocarbons.

The gaseous effluent from the reactor series is cooled and separated into liquid and vapor phases. The phase separation into liquid and vapor portions is often carried out in one or more steps by simply changing the pressure and/or temperature of the effluent. Therefore, in addition to hydrogen, the overhead vapor from the phase separation usually contains light hydrocarbons, particularly methane and ethane. In a closed recycle loop, these components build up, change the reactor equilibrium conditions and can lead to reduced product yield. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged.

Since the reformer is a net hydrogen producer, the overhead vapor is typically split into at least two portions, one for recycle in the reactor loop, the other that forms a purge from the loop and that is frequently submitted to additional separation and treatment. This creates a net hydrogen stream of a relatively high hydrogen concentration, such as above 80% or 90%, for use elsewhere in the plant, and a light hydrocarbon stream to be sent for light ends recovery or to the fuel header.

Hydrogen recovery techniques that have been deployed in refineries include, besides simple phase separation of fluids, pressure swing adsorption (PSA) and membrane separation. U.S. Pat. No. 4,362,613, to Monsanto, describes a process for treating the vapor phase from a high-pressure separator in a hydrocracking plant by passing the vapor across a membrane that is selectively permeable to hydrogen. The process yields a hydrogen-enriched permeate that can be recompressed and recirculated to the hydrocracker reactor. U.S. Pat. No. 4,367,135, also to Monsanto, describes a process in which effluent from a low-pressure separator is treated to recover hydrogen using the same type of hydrogen-selective membrane. U.S. Pat. No. 4,548,619, to UOP, shows membrane treatment of the overhead gas from an absorber treating effluent from benzene production. The membrane again permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,082,481, to Lummus Crest, describes removal of carbon dioxide, hydrogen and water vapor from cracking effluent, the hydrogen separation being accomplished by a hydrogen-selective membrane. U.S. Pat. No. 5,157,200, to Institut Francais du Petrole, shows treatment of light ends containing hydrogen and light hydrocarbons, including using a hydrogen-selective membrane to separate hydrogen from other components. U.S. Pat. No. 5,689,032, to Krause/Pasadyn, discusses a method for separating hydrogen and hydrocarbons from refinery off-gases, including multiple low-temperature condensation steps and a membrane separation step for hydrogen removal. U.S. Pat. No. 5,332,492, to UOP, concerns treatment of effluent gases from catalytic reformers by cooling to between −9° C. and −26° C. followed by PSA.

The use of certain polymeric membranes to treat off-gas streams in refineries is also described in the following papers: "Prism™ Separators Optimize Hydrocracker Hydrogen", by W. A. Bollinger et al., presented at the AIChE 1983 Summer National Meeting, August 1983; and "Optimizing Hydrocracker Hydrogen" by W. A. Bollinger et al., in Chemical Engineering Progress, May 1984. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons. Papers that specifically concern treatment of reformer off-gases are "Hydrogen Purification with Cellulose Acetate Membranes", by H. Yamashiro et al., presented at the Europe-Japan Congress on Membranes and Membrane Processes, June 1984; and "Plant Uses Membrane Separation", by H. Yamashiro et al., in Hydrocarbon Processing, February 1985. In these papers, a system and process using membranes to treat the overhead gas stream from the absorber/recontactor section of the plant are described. All of these papers describe system designs using cellulose acetate or similar membranes that permeate hydrogen and reject hydrocarbons.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

Other references that describe membrane-based separation of hydrogen from gas streams in a general way include U.S. Pat. Nos. 4,654,063 and 4,836,833, to Air Products, and U.S. Pat. No. 4,892,564, to Cooley.

U.S. Pat. No. 5,332,424, to AirProducts, describes fractionation of a gas stream containing light hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Other Air Products patents that show application of carbon adsorbent membranes to hydrogen/hydrocarbon separations include U.S. Pat. Nos. 5,354,547; 5,435,836; 5,447,559 and 5,507,856, which all relate to purification of streams from steam reformers. U.S. Pat. No. 5,634,354, to Air Products, discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen.

U.S. Pat. No. 4,857,078, to Watler, mentions that, in natural gas liquids recovery, streams that are enriched in hydrogen can be produced as retentate by a rubbery membrane.

SUMMARY OF THE INVENTION

The invention is a process for improved catalytic reforming, and specifically for improved recovery of reformate and hydrogen from catalytic reformers. The new process includes a membrane separation treatment, which can be applied to treat overhead gases from the first phase separator section of the plant, as part of the reactor recycle loop, and/or to treat gas purged from this loop, before or after the recontactor/absorber section of the plant. It is particularly preferred to treat the overhead gases that are part of the reactor recycle loop.

In a basic aspect as it includes treatment of gases in the reactor recycle loop, the process of the invention comprises the following steps:

(a) catalytically reforming a hydrocarbon feedstock in a reactor;

(b) withdrawing an effluent stream comprising hydrogen and hydrocarbons from the reactor;

(c) separating a raw reformate liquid phase and a vapor phase, comprising hydrogen and a light hydrocarbon, from the effluent stream;

(d) passing at least a portion of the vapor phase as a feed stream across the feed side of a polymeric membrane having a feed side and permeate side, and being selective for the light hydrocarbon over hydrogen;

(e) withdrawing from the permeate side a permeate stream enriched in the light hydrocarbon compared with the vapor phase;

(f) withdrawing from the feed side a residue stream enriched in hydrogen compared with the vapor phase;

(g) recirculating at least a portion of the residue stream to the reactor.

The invention has an important advantage over other processes including polymeric membrane separation treatment that have been used in the refining industry in the past: the membranes are hydrogen-rejecting. That is, hydrocarbons permeate the membrane preferentially, leaving a residue stream on the feed side that is concentrated in the slower-permeating hydrogen.

This means that the membrane provides a selective purge capability. In a catalytic reformer, the overhead vapor from the first phase separator section is split, with some gas returning to the reactors and some gas being purged and passed to further treatment. The split is made by balancing the need to reuse hydrogen in the reactors against the need for hydrogen as a product for use elsewhere in the plant, in conjunction with the need to purge light hydrocarbons from the reactor and the need to maximize recovery of liquid reformate. The selective purging provided by the invention is very beneficial in this regard. For example, the split between hydrogen recirculated/hydrogen purged can be kept the same as in conventional processes. However, for every pound of hydrogen that is removed from the loop, the invention provides a much higher corresponding removal of hydrocarbons. This controls the hydrocarbon contaminants and facilitates better reformate recovery.

As a secondary benefit, the hydrogen concentration of the recirculated stream is slightly increased. Therefore, under some circumstances, the process can provide, per volume of gas purged, a slightly higher hydrogen partial pressure in the reactor than was achieved previously. This is beneficial in increasing catalyst life and suppressing low-value products.

A further particular benefit is that the recycle stream is retained on the high-pressure side of the membrane. The ability to deliver this recycle gas without the need for recompression from the comparatively low pressure on the permeate side of the membrane is attractive.

In another aspect, the invention includes treating the portion of the vapor phase from the separator that is destined to provide the net hydrogen product, by carrying out the following steps:

(a) catalytically reforming a hydrocarbon feedstock in a reactor;

(b) withdrawing an effluent stream comprising hydrogen and hydrocarbons from the reactor;

(c) separating a raw reformate liquid phase and a vapor phase, comprising hydrogen and a light hydrocarbon, from the effluent stream;

(d) recirculating a portion of the vapor phase to the reactor;

(e) passing at least a portion of the unrecirculated vapor phase as a feed stream across the feed side of a polymeric membrane having a feed side and permeate side, and being selective for the light hydrocarbon over hydrogen;

(f) withdrawing from the feed side a residue stream enriched in hydrogen compared with the vapor phase;

(g) withdrawing from the permeate side a permeate stream enriched in the light hydrocarbon compared with the vapor phase;

(h) passing the permeate stream and a portion of the raw reformate liquid into a contactor;

(i) withdrawing from the contactor a reformate stream enriched in $C_{3+}$ hydrocarbon content compared with the raw reformate liquid;

(j) withdrawing from the contactor a gas stream depleted in $C_{3+}$ hydrocarbon content compared with the permeate stream.

In yet another aspect, the invention includes treatment of the overhead gas stream withdrawn from the raw reformate/vapor phase contactor.

The invention also includes improved catalytic reformer apparatus, comprising a reactor loop incorporating the reactor itself, the phase separation equipment and the membrane separation unit containing a contaminant-selective membrane.

Polymeric materials are used for the membranes. This renders the membranes easy and inexpensive to prepare, and to house in modules, by conventional industrial techniques, unlike other types of hydrogen-rejecting membranes, such as finely microporous inorganic membranes, including adsorbent carbon membranes, pyrolysed carbon membranes and ceramic membranes, which are very difficult and costly to fabricate in industrially useful quantities.

The preferred membranes used in the present invention permeate hydrocarbons and water vapor preferentially over hydrogen, and are capable of withstanding exposure to these materials in high concentrations. This contrasts with cellulose acetate and like membranes, which must be protected from exposure to heavy hydrocarbons and water.

The membrane separation step may be carried out on the entirety of the stream from the phase FEW separation step, or on any convenient portion thereof. The membrane step may take the form of a single step or of multiple sub-steps, depending on the feed composition, membrane properties and desired results.

The phase separation step may be carried out in any convenient manner, as a single-stage operation, or in multiple sub-steps. The effluent from catalytic reformers is typically at high temperature and in the gas phase, so the phase separation step usually starts with cooling to liquefy the heavier components of the stream. Subsequent sub-steps may involve further cooling, flashing, absorption or the like.

Additional separation steps may be carried out elsewhere in the loop as desired to supplement the phase separation or membrane separation steps or to remove secondary components from the stream. For example, the feed stream can be compressed and cooled to knock out an additional hydrocarbon liquid fraction before passing to the membrane separation unit. This is advantageous in reducing the amount and Btu value of fuel gas produced, thereby enabling reactor throughput to be increased in some cases.

It is to be understood that the above summary and the following detailed description are intended to explain and illustrate the invention without restricting its scope.

DETAILED DESCRIPTION OF THE INVENTION

The terms gas and vapor are used interchangeably herein.

The term $C_{2+}$ hydrocarbon means a hydrocarbon having at least two carbon atoms; the term $C_{3+}$ hydrocarbon means a hydrocarbon having at least three carbon atoms; and so on.

The term $C_{2-}$ hydrocarbon means a hydrocarbon having no more than two carbon atoms; the term $C_{3-}$ hydrocarbon means a hydrocarbon having no more than three carbon atoms; and so on. The term light hydrocarbon means a hydrocarbon molecule having no more than about six carbon atoms. The term lighter hydrocarbons means $C_1$ or $C_2$ hydrocarbons. The term heavier hydrocarbons means $C_{3+}$ hydrocarbons.

Percentages herein are by volume unless otherwise stated.

The invention is a process and apparatus for improved catalytic reforming and specifically for improved reformate and hydrogen recovery and contaminant removal in catalytic reformers that include a reactor loop. By a reactor loop, we mean a configuration in which at least a part of the effluent stream from a reactor is recirculated to the reactor. The process can be applied to any loop in which hydrogen is fed to the reactor, and in which hydrogen and one or more hydrocarbons are present in the effluent. A primary goal of the process is to increase recovery of reformate from the gases purged from the reactor loop. A secondary goal is to provide selective purging of contaminant gases from the reactor loop, thereby increasing the hydrogen concentration in the loop.

In a basic aspect, the invention is a process that includes reforming a hydrocarbon feedstock in a reactor, thereby forming hydrocarbons of higher octane number, separating the effluent from the reactor into liquid and vapor portions, purging at least some of the vapor portion selectively by using a hydrogen-rejecting membrane separation unit, and returning the contaminant-depleted stream to the reactor. In another aspect, the invention is apparatus for carrying out the process.

Figure 1:
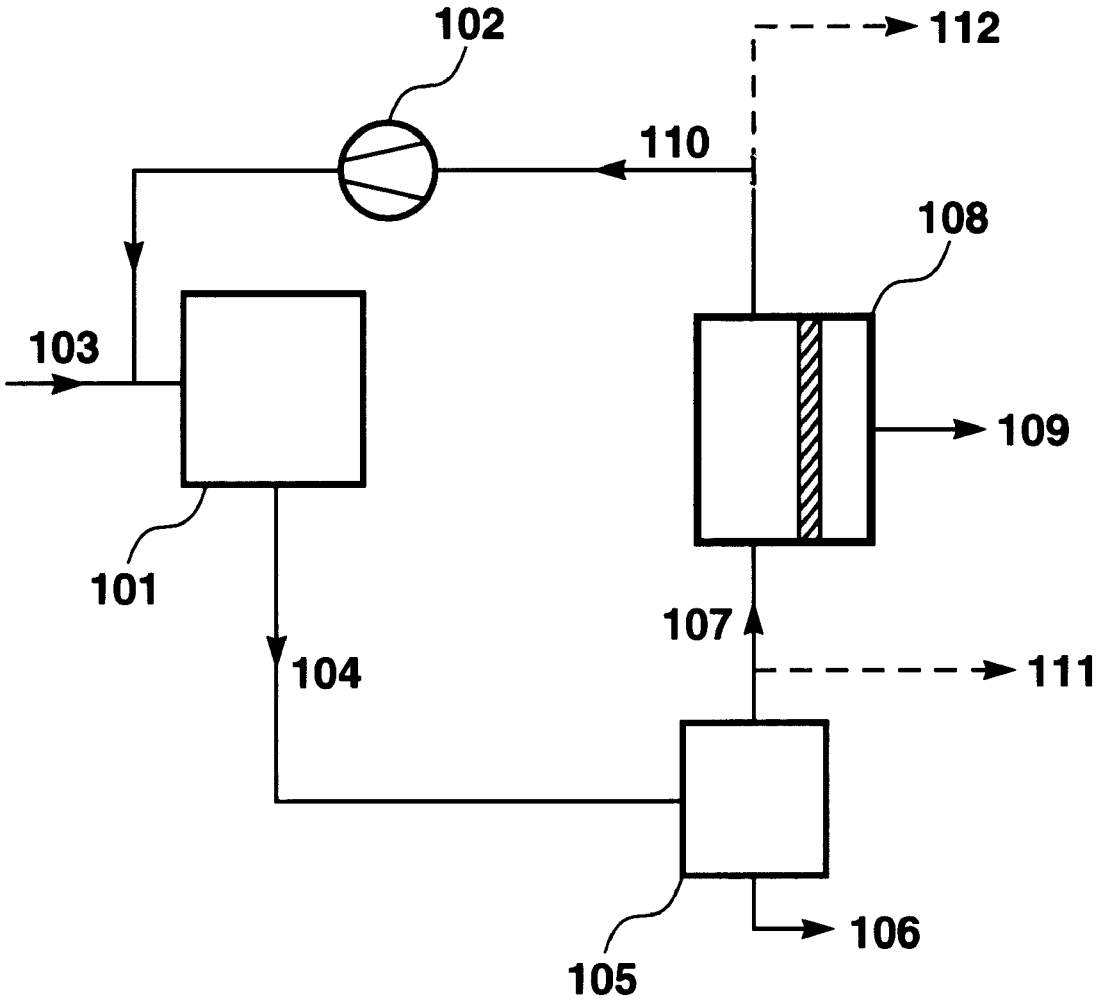
FIG. 1 is a schematic drawing showing a basic embodiment of the invention.

The invention in aspects of this type is shown schematically in FIG. 1. Referring to this figure, box 101 represents the reactor, which may be of any type. Catalytic reforming reactors are well known in the art and do not require any lengthy description herein. A reference that provides discussion of design and operation of modem reformers is Chapter 4 of "Handbook of Petroleum Refining Processes" Second Edition, R. A. Meyers (Ed), McGraw Hill, 1997. In general, three categories of reactor are in use. The oldest, which still account for more than half of current working reactors, are known as semi-regenerative systems. These systems contain three or four reactor vessels with fixed catalyst beds. The reactors are run for a period of typically 6–12 months, then taken off-line for catalyst regeneration. As the on-stream time progresses, the reactor temperature is increased to maintain operating severity. Nevertheless, the reformate yield and hydrogen purity tend to drop slightly over time. The gas from these reactors usually has a hydrogen content of about 75–80%.

The second category is cyclic or swing reactors. These systems contain a chain of fixed-bed reactors that can be switched in and out of service for regeneration independently as needed, so that the system as a whole remains on-line continuously. Cyclic reactors have the potential to produce both higher octane reformate and more hydrogen than semi-regenerative reactors but are more costly and complicated.

The third category of reformer is the continuous catalyst regeneration (CCR) system. In these systems, the multiple reactor stages are mounted together in a vertical stack, and the catalyst forms a moving bed that gradually travels down through the reactor stages, through a regenerator and back to the top of the reactor over a period of up to a week. Hybrid combinations of the individual system types are also possible.

FIG. 1 shows two feed streams, 103, the hydrocarbon charge and 110, the recycle stream, entering the reactor, 101. Very commonly, the streams will be combined as shown and passed through compressors, heat exchangers or direct-fired heaters (not shown) to bring them to the appropriate reaction conditions before entering the reactors. Alternatively, the streams can be prepared and fed separately to the reactor. Commonly, the hydrocarbon stream, 103, itself may be a combination of recycled unreacted hydrocarbons and fresh feed.

As mentioned above, one or multiple reactors may be involved in the process, with the individual reactors carrying out the same or different unit operations. The reactor operating conditions are not critical to the invention and can and will vary depending on the type and specific operating constraints of the reactor. For example, a CCR system may operate at comparatively high temperature, such as 550 ° C., and low pressure, such as below 250 psig, whereas a semi-regenerative system may operate at comparatively low temperature, such as 420 ° C., and high pressure, such as above 500 psig. Thus, the invention embraces all reactor temperature and pressure conditions, although it is expected that these will generally be in the range 300–550° C. and 50–1,000 psig respectively. The reactors can carry out any of the reforming reactions recognized in the art.

The effluent stream, 104, is withdrawn from the reactor. The first treatment step required is to separate the stream into discrete liquid and gas phases, shown as streams 106 (liquid) and 107 (vapor) in FIG. 1. This separation step is indicated simply as box 105, although it will be appreciated that it can be executed in one or multiple sub-steps. For example, the effluent from a reformer may be at 500° C. and may be reduced in temperature in three stages to 50° C. The cooling step or steps may be performed by heat exchange against other plant streams, such as the hydrogen and hydrocarbon streams incoming to the reactor and/or by using air cooling, water cooling or refrigerants, depending on availability and the desired final temperature. Such techniques are familiar to those of skill in the art. The physical nature of the separator vessel can be chosen from simple gravity separators, cyclone separators or any other convenient type.

The raw reformate liquid stream, 106, is withdrawn and passed to downstream treatment. Such treatments, include, but are not limited to, stabilization to remove light ends and NGL, and fractionation, and are familiar to those of skill in the art.

The vapor phase is withdrawn as stream 107. For ease of understanding the invention, FIG. 1 shows the simplest case in which the entirety of the vapor phase passes to the membrane purge step, 108. However, dashed arrow 111 is intended to indicate that only a portion of the vapor phase may pass to the membrane separation step, and another portion may be withdrawn from the loop as a supplementary unselective purge, and/or for treatment to recover hydrogen for use elsewhere. Such variants are discussed below, and will become apparent to those of skill in the art when the teachings with regard to FIG. 1 have been understood.

The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{2+}$ organic molecules. For rubbery or elastomeric polymers, the difference in size is much less critical, because the polymer chains can be flexed, and sorption effects generally dominate the permeability. Elastomeric materials, therefore, tend to permeate large, condensable molecules faster than small, low-boiling molecules. Thus, most rubbery materials are selective in favor of all $C_{3+}$ hydrocarbons over hydrogen. However, for the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2.

Any rubbery material that is selective for $C_{2+}$ hydrocarbons over hydrogen will provide selective purging of these components and can be used in the invention. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrene/butadiene/styrene block copolymers, styrene/ethylene/butylene block copolymers, and thermoplastic polyolefin elastomers.

The preferred membrane differs from other membranes used in the past in refinery and petrochemical processing applications in that it is more permeable to all hydrocarbons, including methane, than it is to hydrogen. In other words, unlike almost all other membranes, rubbery or glassy, the membrane is methane/hydrogen selective, that is, hydrogen rejecting, so that the permeate stream is hydrogen depleted and the residue stream is hydrogen enriched, compared with the membrane feed stream. To applicants' knowledge, among the polymeric membranes that perform gas separation based on the solution/diffusion mechanism, silicone rubber and closely related polymers are the only materials that are selective in favor of methane over hydrogen. As will now be appreciated by those of skill in the art, at least some of the benefits that accrue from the invention derive from the use of a membrane that is both polymeric and hydrogen rejecting. Thus, any polymeric membrane that is found to have a methane/hydrogen selectivity greater than 1 can be used for the processes disclosed herein and is within the scope of the invention. For example, other materials that might perhaps be found by appropriate experimentation to be methane/hydrogen selective include other polysiloxanes. Also, U.S. Pat. No. 4,370,150 cites data for silicone-polycarbonate copolymermembranes that suggest apure gas selectivity of about 1.3 for methane over hydrogen, but this would, of course, depend on the exact composition of the polymer and the other components of an actual gas.

Another class of polymer materials that has at least a few members that should be methane/hydrogen selective, at least in multicomponent mixtures including other more condensable hydrocarbons, is the superglassy polymers, such as poly(1-trimethylsilyl-1-propyne) [PTMSP] and poly(4-methyl-2-pentyne) [PMP]. These differ from other polymeric membranes in that they do not separate component gases by solution/diff-union through the polymer. Rather, gas transport is believed to occur based on preferential sorption and difflusion on the surfaces of interconnected, comparatively long-lasting free-volume elements. Membranes and modules made from these polymers are less well developed to date; this class of materials is, therefore, less preferred than silicone rubber.

The membrane separation step is used to purge contaminants from the recycle loop; this purged contaminant portion is removed as permeate stream 109. The membranes used in the invention permeate hydrocarbons, hydrogen sulfide, carbon monoxide, carbon dioxide, water vapor, ammonia and other condensable gases faster than hydrogen. Thus, permeate stream 109 is substantially enriched in hydrocarbons, and the other components mentioned above, if they are present, and depleted in hydrogen, compared with feed stream 107.

This selective purging capability can be used to advantage in several ways. In a catalytic reformer, the overhead vapor from the first phase separator section is usually split, with some gas - returning to the reactors to maintain an appropriate hydrogen partial pressure and control coking of the catalyst, and some gas being purged and passed to further treatment for hydrogen recovery. The split is made by balancing the need to reuse hydrogen in the reactors against the need for hydrogen as a product for use elsewhere in the plant. Other factors that must be taken into account and balanced include the need to purge the light hydrocarbons, in particular $C_{4-}$ hydrocarbons, from the reactor and the need to maximize recovery of liquid reformate. For example, suppose that in a prior art process, a split of 60% recycle and 40% purge was made in the stream, resulting in a raw hydrogen yield in the purge stream of 3,000 lb/h. For a typical reformer, the purge stream might also contain about 20,000 lb/h of total hydrocarbons. Under the selective purging regime of the invention, removal of this same 3,000 lb/h of hydrogen from the reformer in the purge cut can be accompanied by a total hydrocarbon content in the purge cut from the recycle of as much as 30,000 lb/h, 40,000 lb/h or more. When this stream enters the recontactor/absorber section, a greater yield of liquid reformate will result, as illustrated in the Examples section below.

In another aspect, the invention can provide lower levels of secondary contaminants, such as ammonia, in the reactor. Suppose it is desired to operate the reactor to maintain hydrogen return from the vapor stream at 50%. Absent the membrane separation step, this would be accomplished by dividing stream 107 in half, directing one half to the purge, the other back to the reactor. Suppose this had the effect of returning 150 lb/h of ammonia to the reactor. By passing the purge stream through the membrane separation unit, a purge stream is created that has more ammonia per unit of hydrogen than was present in the feed, and a residue, recycle stream is created that has less ammonia per unit of hydrogen than was present in the feed. Thus, the hydrogen return can be maintained at the desired level, but results in a lesser amount of ammonia, for example, only 130 lb/h, being returned to the reactor mix. This provides a mechanism for improving the reactor conditions, and may enable the feed throughput of the reactor to be increased, and/or the cycle time to be extended.

From another perspective, by selectively removing the non-hydrogen components, the process results in a membrane residue stream, 110, that is enriched in hydrogen content compared with stream 107. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component in the feed. This can be accomplished by increasing the stage-cut of the membrane separation step, that is, the ratio of permeate flow to feed flow, to the point that little except hydrogen is left in the residue stream. As the stage-cut is raised, however, the purge becomes progressively less selective. This can be clearly seen by considering that, in the limit, if the stage-cut were allowed to go to 100%, all of the gas present in the feed would pass to the permeate side of the membrane and the purge would become completely unselective. Since the purpose of the invention is to provide hydrocarbon selective purging, a very high stage-cut, and hence a high hydrogen concentration in the residue, defeats the purpose of the invention. It is preferred, therefore, to keep the stage-cut low, such as below 50%, more preferably below 40% and most preferably below 30%. Those of skill in the art will appreciate that within these guidelines, the stage-cut can be chosen to meet the desired purging objectives, in terms of hydrogen and hydrocarbon removal. Based on the above considerations, the residue stream, 110, will usually be higher in hydrogen concentration than the feed, but by no more than about 1%, 2% or 5%. This in turn will lead to a slightly higher hydrogen partial pressure in the reactor. Even though this partial pressure increase is small, it may be beneficial in improving desired product yield and prolonging catalyst life. These same considerations lead to a permeate stream that is usually significantly higher in total hydrocarbon concentration than the feed stream, such as at least about 5%, 10%, 15% or even 20% higher.

An advantage of using a hydrogen-rejecting membrane is that the stream that is recirculated in the reactor loop remains on the high-pressure side of the membrane. This reduces recompression requirements, compared with the situation that would obtain if a hydrogen-selective membrane were to be used. In that case, the permeate stream might be at only 10% or 20% the pressure of the feed, and would need substantial recompression before it could be returned to the reactor.

A benefit of using silicone rubber or superglassy membranes is that they provide much higher transmembrane fluxes than conventional glassy membranes. For example, the permeability of silicone rubber to methane is 800 Barrer, compared with a permeability of only less than 10 Barrer for 6FDA polyimide or cellulose acetate.

The membrane may take any convenient form known in the art. The preferred form is a composite membrane including a microporous support layer for mechanical strength and a silicone rubber coating layer that is responsible for the separation properties. Additional layers may be included in the structure as desired, such as to provide strength, protect the selective layer from abrasion, and so on.

The membranes may be manufactured as flat sheets or as fibers and housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. Since conventional polymeric materials are used for the membranes, they are relatively easy and inexpensive to prepare and to house in modules, compared with other types of membranes that might be used as hydrogen-rejecting membranes, such as finely microporous inorganic membranes, including adsorbent carbon membranes, pyrolysed carbon membranes and ceramic membranes.

To achieve a high transmembrane hydrocarbon flux, the selective layer responsible for the separation properties should be thin, preferably, but not necessarily, no more than 30 $\mu$m thick, more preferably no more than 20 $\mu$m thick, and most preferably no more than 5 $\mu$m thick. If superglassy materials are used, their permeabilities are so high that thicker membranes are possible.

A driving force for transmembrane permeation is provided by a pressure difference between the feed and permeate sides of the membrane. As mentioned above, at least some of the reactions within the scope of the invention will involve high pressure conditions in the reactor, and at least some of the phase separation steps will maintain the vapor at a high pressure, such as 200 psig, 500 psig or above. Feed pressures at this level will be adequate in many instances to provide acceptable membrane performance. In favorable cases such as this, the membrane separation unit requires no additional compressors or other pieces of rotating equipment than would be required for a prior art process without selective purging. The recycle stream remains at or close to the pressure of the separator overhead, subject only to a slight pressure drop along the feed surface of the membrane modules, and can, therefore, be sent to a recycle compressor of essentially the same capacity as would have been required in the prior art system. If the pressure of stream 107 is insufficient to provide adequate driving force, a compressor may be included in line 107 between the phase separation step and the membrane separation step to boost the feed gas pressure.

Depending on the composition of the membrane feed stream 107, a single-stage membrane separation operation may be adequate to produce a permeate stream with an acceptably high contaminant content and low hydrogen content. If the permeate stream requires further separation, it may be passed to a second bank of modules for a second-stage treatment. If the second permeate stream requires further purification, it may be passed to a third bank of modules for a third processing step, and so on. Likewise, if the residue stream requires further contaminant removal, it may be passed to a second bank of modules for a second-step treatment, and so on. Such multistage or multistep processes, and variants thereof, will be familiar to those of skill in the art, who will appreciate that the membrane separation step may be configured in many possible ways, including single-stage, multistage, multistep, or more complicated arrays of two or more units in series or cascade arrangements. Representative embodiments of a few of such arrangements are given in copending Ser. No. 09/083,660 entitled "Selective Purge for Reactor Recycle Loop".

Membrane permeate purge stream 109 exits the reactor loop. Membrane residue stream 110 is withdrawn from the feed side of the membrane unit and recirculated, at least in part, to the reactor inlet. Following the phase separation and membrane separation steps, some small amount of recompression is usually needed to bring stream 110 back to reactor pressure, and this can be accomplished by directing stream 110 through an optional booster compressor, 102.

It will be appreciated that the configuration of FIG. 1 provides several options in terms of membrane separation treatment of the portions of the overhead vapor that are recirculated and are removed to provide net hydrogen for other purposes. Thus, the stream can be divided into streams 107 and 111 before membrane step 108, can be divided only by membrane step 108 into streams 109 and 110, or can be divided after membrane step 108 into streams 110 and 112. In other words, a choice can be made whether to treat by membrane separation only the gas destined for recirculation within the loop, only the gas to be removed from the loop, or all of the gas. Some preferred, but non-limiting representative embodiments illustrating these choices are now described.

Figure 2:
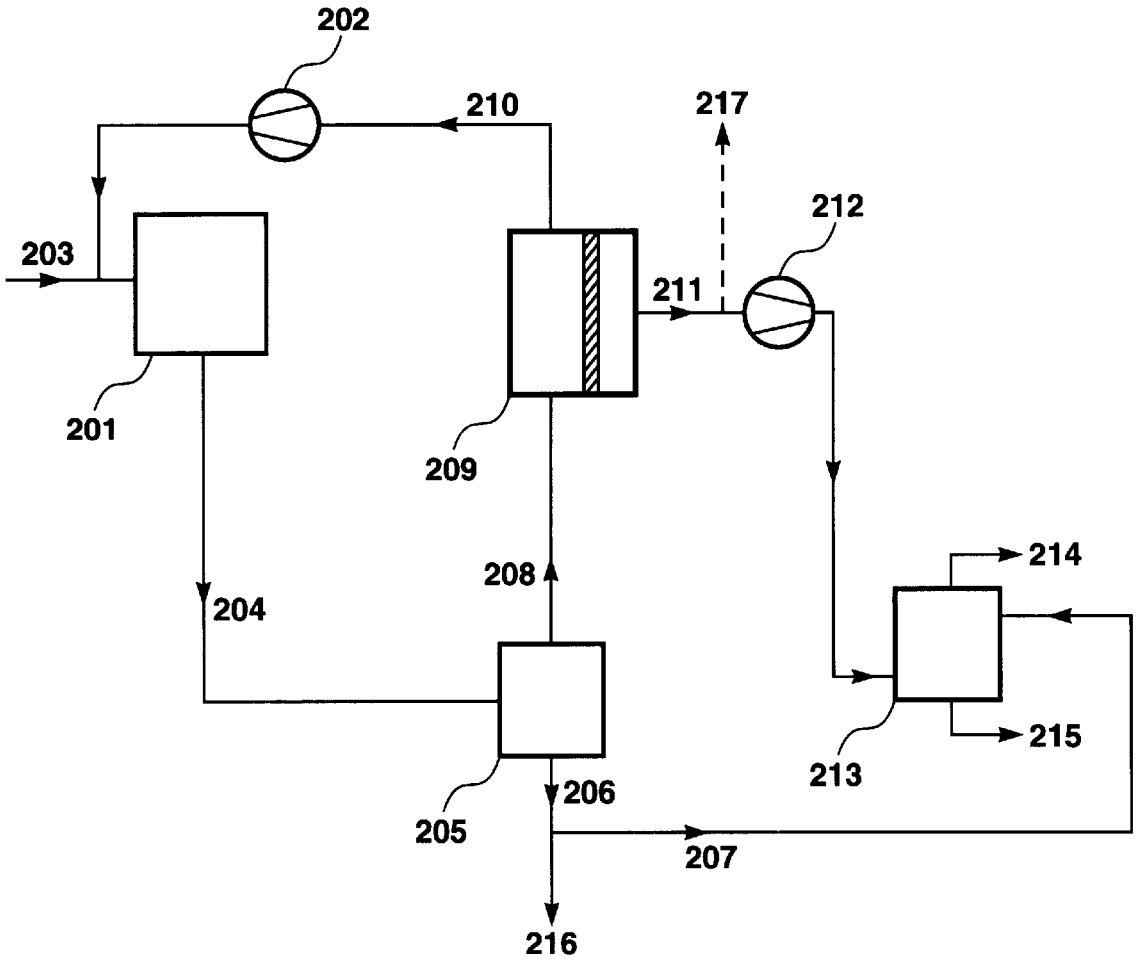
FIG. 2 is a schematic drawing showing a preferred embodiment including recontacting the membrane permeate stream with a portion of the raw refonmate stream.

FIG. 2 shows a preferred embodiment in which all of the overhead vapor from the separator is treated by the membrane separation step to provide a selective hydrocarbon-enriched purge. Referring to this figure, hydrocarbon charge, 203, and recycle stream, 210, are brought to the desired conditions and introduced into the reactor or reactors, 201. Effluent stream 204 is withdrawn and us enters phase separation step 205, which can be executed in any convenient manner, as described for FIG. 1 above. Liquid phase, 206, is withdrawn. A portion of this unstabilized reformate is withdrawn as stream, 216, and sent to fractionation or other treatment as known in the art. The remainder of the raw reformate, typically comprising up to about 50% of stream 206, is passed as stream, 207, to recontactor, 213. Vapor phase, 208, is withdrawn from the separator and passed to o membrane separation step, 209. The membrane unit divides the vapor stream into permeate stream, 211, enriched in reformate hydrocarbons and contaminants and depleted in hydrogen, and residue stream, 210, which is passed through optional compressor, 202, and returned to the inlet side of the reactors. Stream 211 is compressed in compressor, 212, and introduced into recontactor, 213. Prior to compression, a purge stream, 217, can optionally be taken from stream 211 to limit carry over of contaminants into product streams 214 and 215 as desired.

The recontactor may be of any type known in the art, such as a single-stage contactor vessel or a trayed or packed absorption column. Within the contactor, the hydrocarbon-enriched permeate and the unstabilized reformate are brought into equilibrating contact, resulting in transfer of $C_{3+}$ components from the permeate to the reformate. Although the recontacting operation is carried out essentially as in prior art processes, the hydrocarbon-enriched nature of the permeate results in greater transfer of heavier hydrocarbons into the reformate liquid and thus better overall liquids recovery from the process. Typically, prior art absorber/recontactor units are operated at low temperature, such as below 0° C., for example, about −10° C., −20° C. or below, to facilitate good capture of the $C_{3+}$ hydrocarbons into the liquid phase. Temperatures in this range can be reached by passing incoming. streams 211 and 207 through heat exchangers against outgoing streams 214 and 215, plus external chilling, for simplicity none of which is shown in the figure. Compared with prior art reformers, the vapor purge stream 211 passing to the recontactor will contain both a higher percentage and a higher weight of $C_{3+}$ hydrocarbons. In some cases, this will enable the recontact/absorption step to be carried out at a higher temperature than previously, such as in favorable cases even above −20° C., above −10° C. and even above 0° C. This saves both on complexity and costs of this portion of the plant.

The reformate phase is withdrawn as stream 215 and passed for further fractionation, stabilization, etc. as desired. The overhead gas from the recontactor, stream 214, is now rich in hydrogen, such as 80% hydrogen, 85% hydrogen, 90% hydrogen or more and is withdrawn for use as hydrogen feed either directly or after additional upgrading if desired.

As was described with respect to the embodiment of FIG. 1, it will be appreciated that the membrane area and operating parameters of the invention of FIG. 2 can be set to achieve a variety of results. For example, the system could be configured to purge a certain amount of hydrogen, say 3,000 lb/h, from the reactor loop. In this case, the invention will provide a higher reformate liquid yield than would be possible for the same amount of hydrogen purge in a prior art design.

Figure 3:
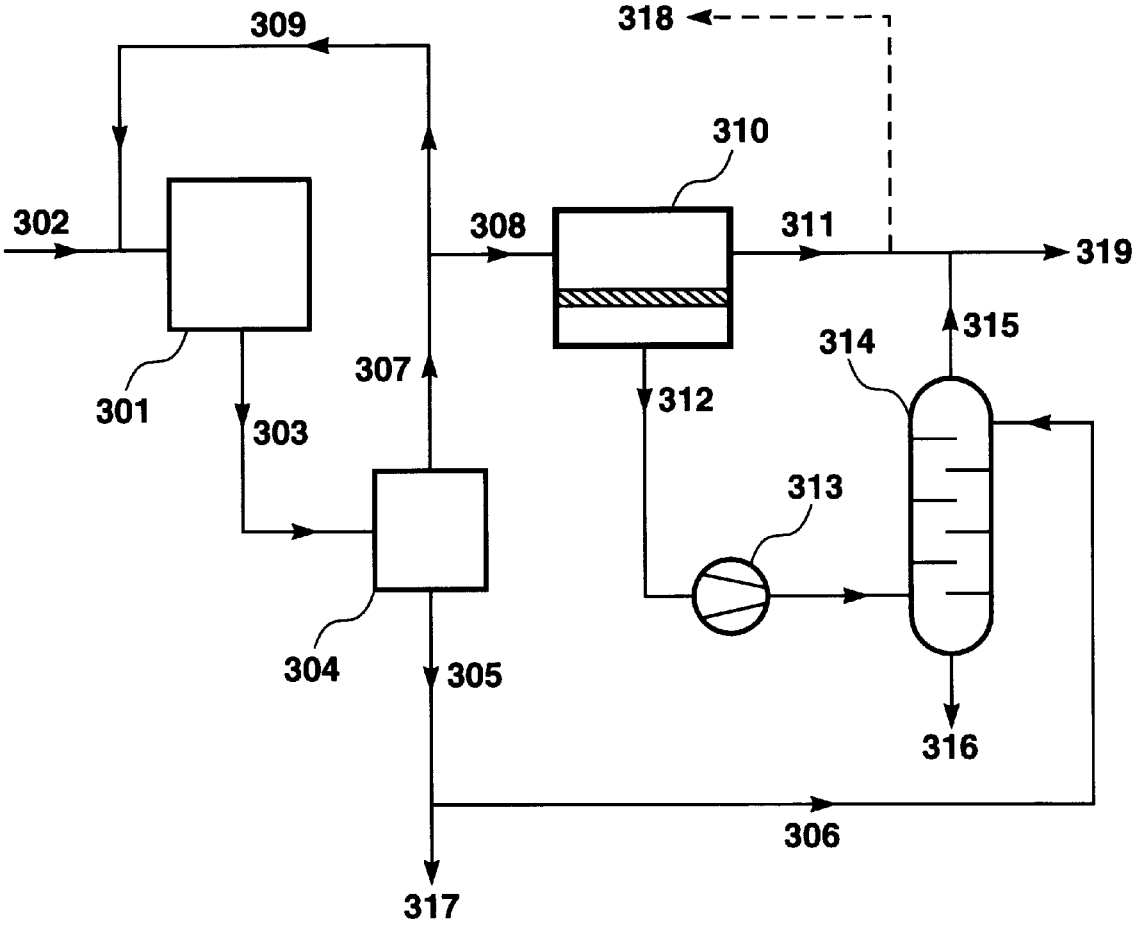
FIG. 3 is a schematic drawing showing a preferred embodiment of the invention in which the membrane separation step treats the stream purged from the reactor recycle loop.

Turning to FIG. 3, this shows another preferred embodiment in which the membrane separation step is installed in the purge line from which contaminants, net hydrogen and additional reformate are withdrawn. Hydrocarbon charge, 302, and recycle stream, 309, are brought to the desired conditions and introduced into the reactor or reactors, 301. Effluent stream 303 is withdrawn and enters phase separation step 304, which can be executed in any convenient manner, as described for FIG. 1 above. Liquid phase, 305, is withdrawn. A portion of this unstabilized reformate is withdrawn as stream, 317, and sent to fractionation or other treatment as known in the art. The emainder of the raw reformate, is passed as stream, 306, to recontactor, 314. Vapor phase, 307, is withdrawn from the separator. The vapor stream is split into two portions, 309, which is passed through an optional booster compressor, not shown, and returned to the reactors, and 308, which is passed to membrane separation step, 310. The membrane unit divides the purge stream into permeate stream, 312, enriched in reformate hydrocarbons and depleted in hydrogen, and residue stream, 311, enriched in hydrogen and depleted in reformate hydrocarbons. Stream 312 is compressed in compressor, 313, and introduced into recontactor, 314. The recontactor may be of any type known in the art, such as a single-stage contactor vessel or a trayed or packed column. For illustration, the figure shows an absorption column. In this case, stream 306 is introduced into the top of the column and runs down the column against the upflowing permeate vapor stream 312. To facilitate transfer of hydrocarbons into the liquid phase, it is preferred to operate the column at a low temperature, following the same considerations and preferences as discussed with respect to FIG. 2 above. As described above, the incoming streams can be cooled against the outgoing streams, by external refrigeration of the streams, or a combination of both. The reformate phase is withdrawn as stream 316 and passed for further fractionation, stabilization, etc. as desired. The overhead gas from the 332 recontactor, stream 315, is now rich in hydrogen, such as 80% hydrogen, 85% hydrogen, 90% hydrogen or more. This stream can be withdrawn alone for use as hydrogen feed either directly or after additional upgrading if desired. Alternatively, stream 315 may be combined with all or part of stream 311 to from net hydrogen product, 319, as shown.

As yet another option, a portion of stream 311 may be split off, as indicated by dashed line 318, and recirculated to the reactor.

Figure 4:
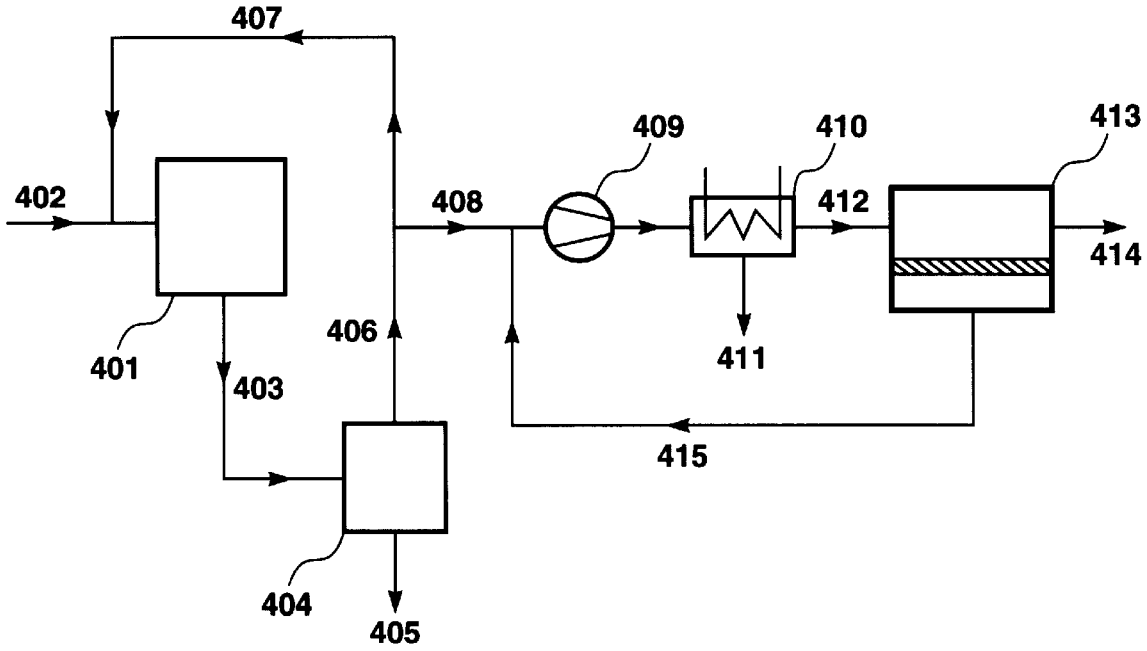
FIG. 4 is a schematic drawing showing an embodiment of the invention in which the feed to the membrane modules is compressed and cooled to remove a liquid hydrocarbon fraction.

FIG. 4 shows yet another embodiment similar to that of FIG. 3 in that the recycle gas is returned in the reactor loop without passing through the membrane separation step and the gas removed from the reactor loop is treated by membrane separation. In this case, hydrocarbon charge, 402, and recycle stream, 407, are brought to the desired conditions and introduced into the reactor or reactors, 401. Effluent stream 403 is withdrawn and enters phase separation step 404. Liquid raw reformate phase, 405, is withdrawn. Vapor phase, 406, is withdrawn from the separator and split into two portions, 407, which forms the reactor return loop, and 408, the stream purged from the loop. In this embodiment, stream 408 is raised in pressure by passing through compressor, 409, and is cooled in chiller/condenser, 410. Uncondensed stream 412 passes to the membrane separation unit, 413, where it is separated into permeate stream 415, enriched in hydrocarbons, and residue stream 414, enriched in hydrogen. Stream 414 may then be subjected to additional treatment to enhance the hydrogen purity, or may be sent directly for use as a hydrogen source, for example. Permeate stream 415 is recirculated to the inlet side of compressor 409 and passes again through the condenser/membrane loop. The addition of this hydrocarbon-enriched stream, 415, to stream 408 raises the overall concentration of hydrocarbons in the gas passing through the compressor and chiller. The pressure and temperature of the compression/condensation section are chosen in conjunction with the composition of the incoming gas so that a portion of the heavier hydrocarbon components is knocked out as a further reformate liquid fraction, 411. This additional hydrocarbon liquid can be added to raw reformate stream 405, or otherwise handled as desired. The invention in this embodiment is particularly advantageous in handling light overhead vapor streams, that is, those that are comparatively rich in hydrogen and comparatively lean in $C_{3+}$ hydrocarbons The use of the membrane separation unit following the compression/condensation section enhances recovery, because the hydrocarbon concentration can be built up by recirculating stream 415. In this way recovery of additional liquids under pressure/temperature conditions where no useful condensation would otherwise occur is possible. Such combinations of compression/condensation with membrane separation are taught in U.S. Pat. Nos. 5,089,033; 5,199,962; 5,205,843; and 5,374,300, where more specific details in terms of selecting operating parameters and so on may be found.

Figure 5:
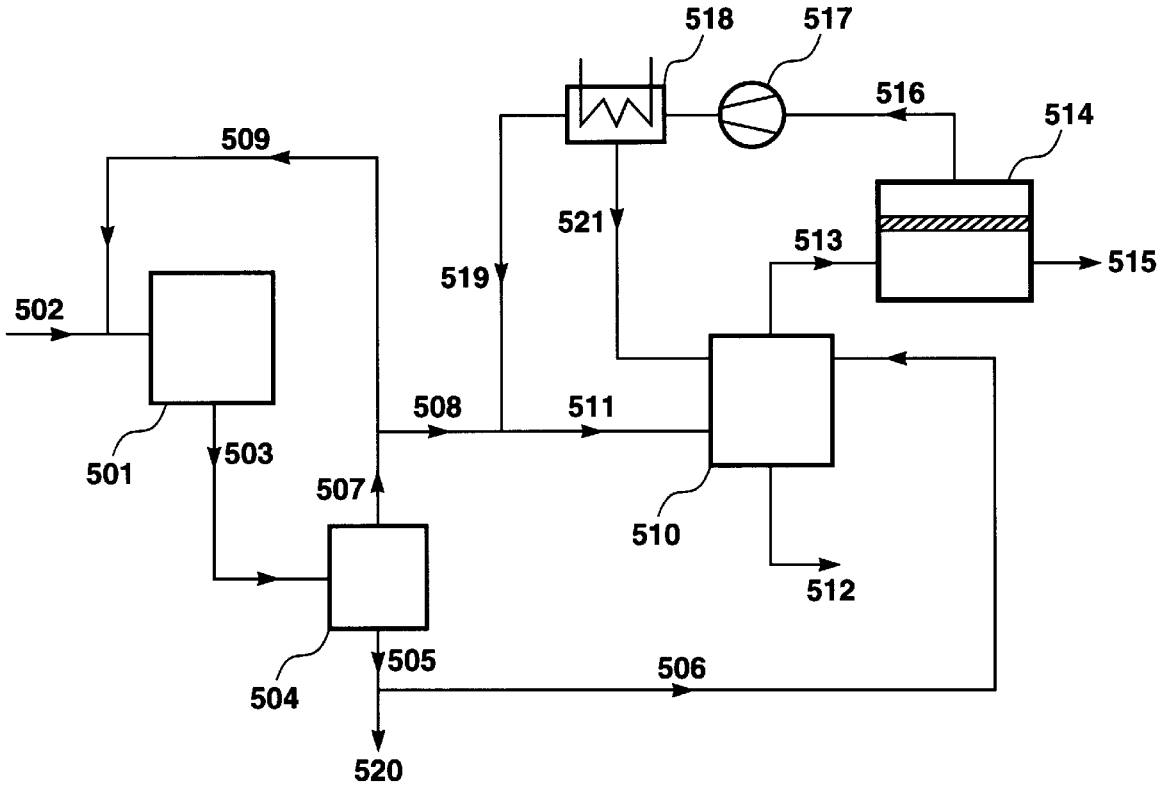
FIG. 5 is a schematic drawing showing an embodiment of the invention in which the membrane separation step treats the overhead gas from the absorber/recontactor.

An embodiment in which the membrane separation step is carried out on the overhead vapor from the recontactor section is shown in FIG. 5. Referring to this figure, hydrocarbon charge, 502, and recycle stream, 509, are brought to the desired conditions and introduced into the reactor or reactors, 501. Effluent stream 503 is withdrawn and enters phase separation step 504. Liquid raw reformats phase505, is withdrawn and split into two portions, 520, which is withdrawn, and 506, which is passed to the contactor. Vapor phase, 507, is withdrawn from the separator and is also split into two portions, 509, which forms the reactor return loop, and 508, the stream purged from the loop, which is cooled to an appropriate temperature, as discussed with the respect to the earlier-described embodiments, and introduced as stream 511 into recontactor, 510. The recontactor may be of any type and, as described above, effects a second separation in which part of the hydrocarbon vapor is partitioned into the liquid phase. The liquid reformate thus formed is withdrawn as stream 512.

The overhead gas from the recontactor, stream 513, is passed to membrane separation step, 514. The membrane unit divides the overhead stream into permeate stream, 516, enriched in hydrocarbons and depleted in hydrogen, and residue stream, 515, enriched in hydrogen and depleted in hydrocarbons. Stream 515 is the hydrogen product stream from the process and is withdrawn for further treatment or use as required. Enriched hydrocarbon stream 516 is suitable for reintroduction into the contactor, 510, to which end it is recompressed in compressor, 517, and cooled in chiller, 518. As with other streams, cooling can be accomplished by heat exchange against other process streams, by external refrigeration or a combination of both. As a result of compression and cooling, a liquid fraction forms and is introduced into the contactor as stream 521. Uncondensed gases are fed back to the vapor inlet of the contactor as stream 519. Thus the process produces hydrogen as stream 515, and reformate as streams 512 and 520, which can be combined and subjected to fractionation or other treatment as desired. The invention in this embodiment is particularly useful when conditions are such that, without further treatment, the overhead stream, 513, from a prior art process would still contain a relatively large amount of hydrocarbon.

The figures also show the elements of the apparatus of the invention in various embodiments. For example, referring again to FIG. 3, lines 302 and 309 form the feed stream inlet line carrying the raw hydrocarbon feedstock and the recycle hydrogen, respectively, to the reactor 301. The reactor is capable of carrying out the type of reforming reactions described, and has an effluent outlet line, 303, through which fluid can pass, either directly as shown or via some intermediate treatment, to the phase separator or separators, 304. The phase separator has a liquid outlet line, 305, and a vapor outlet line, 307. The vapor outlet line is connected, either directly as shown through feed side inlet line 308, or via intermediate equipment as appropriate, to the feed side of membrane separation unit, 310. This unit contains membranes that are selective in favor of a light hydrocarbon over hydrogen, so as to produce a hydrocarbon-enriched permeate stream and a hydrocarbon-depleted, hydrogen-enriched residue stream. The membrane unit has a permeate side outlet line 312 and a residue, feed-side outlet line, 311, with optional connection 318 so that hydrogen-enriched residue gas can be passed back into the reactor. The permeate side outlet line is connected to contactor 314 through optional compressor 313. The liquid outlet line from the phase separator is also connected to the contactor through line 306, so that part of the raw reformate can be brought into contact with the permeate vapors from the membrane. The contactor has a reformate outlet line 316 and an overhead gas outlet line 315, with optional connection to line 311 to form gas discharge line 319.

The invention is now further described by the following examples, which are intended to be illustrative of the invention, but are not intended to limit the scope or underlying principles in any way.

EXAMPLE 1

A computer calculation was performed with a modeling program, ChemCad III (ChemStations, Inc., Houston, Tex.), to simulate the treatment of an overhead stream from a reformer.

We assumed the process design of FIG. 4. In this figure, feed stream 402, mixed with hydrogen recycle stream 407, enters reformer 401. Reformer effluent 403 is withdrawn and enters phase separator 404, which yields refonnate liquid 405 and off-gas stream 406. Stream 406 is split into hydrogen recycle stream 407 and purge stream 408. Stream 408 is compressed in compressor 409, and cooled in chiller/condenser 410. Condensed stream 411 may be added to reformate liquid stream 405 or otherwise handled as desired. Uncondensed stream 412 passes to the membrane separation unit, 413, where it is separated into permeate stream 415, enriched in hydrocarbons, and residue stream 414, enriched in hydrogen. The permeate stream is recirculated to the inlet side of compressor 409 for further treatment in the condenser/membrane loop. Residue stream 414 may be subjected to additional treatment to enhance the hydrogen purity, or may be sent directly for use as a hydrogen source elsewhere in the plant, for example. Although not indicated in this figure, a portion of residue stream 414 may optionally be combined with the hydrogen recycle stream 407 back to the reformer.

The reformer effluent stream was assumed to have a flow rate of approximately 70 MMscfd, to be at a temperature of 514° C. and a pressure of 75 psia, and to have the following composition:

| | |
|---|---|
| Hydrogen | 72.3% |
| Methane | 3.2% |
| Ethane | 2.5% |
| Propane | 6.6% |
| Butanes | 7.9% |
| $C_5$+ | 7.5% |

Membrane pressure-normalized fluxes were assumed to be as follows, as are typical of a silicone rubber membrane:

| | |
|---|---|
| Hydrogen | $150 \times 10^{-6}$ cm$^3$(STP)/cm$^2$ · sec · cmHg |
| Methane | $200 \times 10^{-6}$ cm$^3$(STP)/cm$^2$ · sec · cmHg |
| Ethane | $480 \times 10^{-6}$ cm$^3$(STP)/cm$^2$ · sec · cmHg |
| Propane | $730 \times 10^{-6}$ cm$^3$(STP)/cm$^2$ · sec · cmHg |
| Butanes | $900 \times 10^{-6}$ cm$^3$(STP)/cm$^2$ · sec · cmHg |
| $C_5$+ | $1{,}100 \times 10^{-6}$ cm$^3$(STP)/cm$^2$ · sec · cmHg |

The results of the calculations are shown in Table 1. The stream numbers correspond to FIG. 4.

TABLE 1

| Component/ Parameter | Stream 403 | Stream 405 | Stream 406 | Stream 408 | Stream 411 | Stream 412 | Stream 415 | Stream 414 |
|---|---|---|---|---|---|---|---|---|
| Molar Flow Rate (lbmol/h) | 7,606 | 450.7 | 7,155 | 2,862 | 425 | 3,733 | 1,295 | 2,439 |
| Mass Flow Rate | 124,018 | 33,877 | 90,141 | 36,056 | 23,182 | 30,319 | 17,439 | 12,880 |

TABLE 1-continued

| Component/ Parameter | Stream 403 | Stream 405 | Stream 406 | Stream 408 | Stream 411 | Stream 412 | Stream 415 | Stream 414 |
|---|---|---|---|---|---|---|---|---|
| (lb/h) | | | | | | | | |
| Temperature (° C.) | 514 | 10 | 10 | | −1 | 4 | 1 | 1 |
| Pressure (psia) | 75 | 70 | 70 | 70 | 70 | 450 | 70 | 440 |
| Component (mol %) | | | | | | | | |
| Hydrogen | 72.3 | 0.5 | 76.8 | 76.8 | 4.4 | 82.9 | 70.7 | 89.4 |
| Methane | 3.2 | 1.0 | 3.4 | 3.4 | 0.8 | 4.0 | 4.1 | 3.9 |
| Ethane | 2.5 | 0.6 | 2.6 | 2.6 | 4.4 | 3.6 | 6.1 | 2.3 |
| Propane | 6.6 | 5.2 | 6.7 | 6.7 | 27.7 | 6.1 | 12.1 | 3.0 |
| Butanes | 7.9 | 19.6 | 7.2 | 7.2 | 40.8 | 3.0 | 6.3 | 1.3 |
| $C_5$+ | 7.5 | 73.9 | 3.4 | 3.4 | 22.0 | 0.4 | 0.8 | 0.1 |

Membrane Area = 997 $m^2$
Theoretical Horsepower = 3,659 hp

EXAMPLES 2–9

Comparative calculations were carried out to contrast the performance of the invention with prior art unselective purging for recovery of hydrogen from catalytic reformers. The calculations were performed using a modeling program ChemCad III (ChemStations, Inc., Houston, Tex.). The effluent from the reformer was assumed to be treated by the following steps, as are common to most reformers:

(a) cool the raw effluent and separate into vapor and raw liquid reformate phases, (b) recirculate part of the vapor to the reformer, (c) recontact unrecirculated vapor against a part of the raw reformate liquid at low temperature and separate into liquid reformate and overhead gas, (d) purge the overhead gas.

The effluent from the reformer reactors was assumed to have a flow rate of approximately 70 MMscfd, to be at a temperature of 510 ° C. and a pressure of 75 psia, and to have the following composition:

| | |
|---|---|
| Hydrogen | 72.3% |
| Methane | 3.2% |
| Ethane | 2.5% |
| Propane | 6.6% |
| Butanes | 7.9% |
| $C_5$+ | 7.5% |

Figure 6:
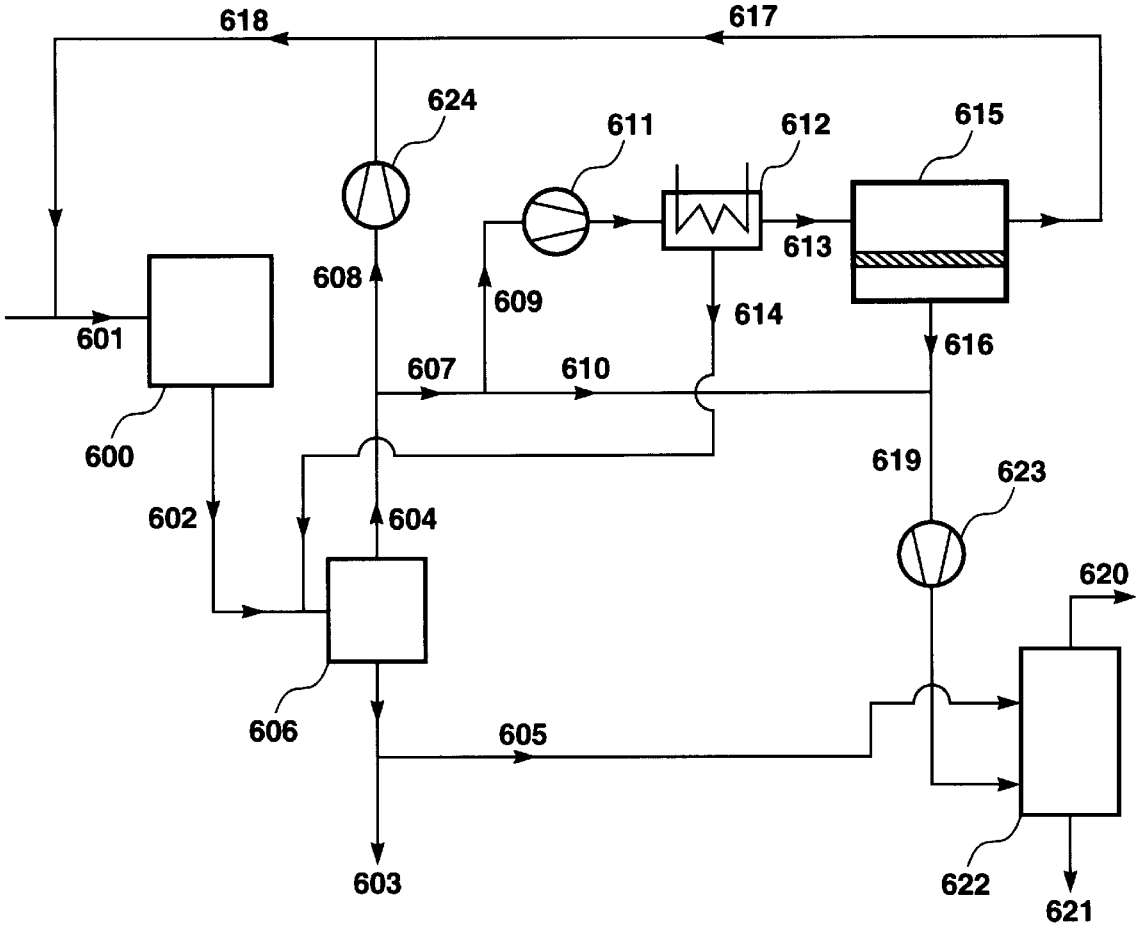
FIG. 6 is a schematic drawing showing an embodiment of the invention in which additional hydrogen is recirculated to the reactors.

The treatment process was assumed to follow the process scheme of FIG. 6. In FIG. 6, the hydrogen- and hydrocarbon-containing feed stream, 601, is passed to reformer 600. Reformer effluent 602 passes to phase separator 606, which yields a liquid reformate product stream and an off-gas stream, 604. The raw reformate stream is split into two portions—stream 603, which is withdrawn, and stream 605, which is passed to recontactor 622. The off-gas stream is split into a recycle stream, 608, which is directed through booster compressor 624 back to the reformer, and a purge stream, 607. The purge stream itself is split into stream 610, which passes directly to the recontactor, and stream 609, which is diverted for membrane treatment. This stream is compressed in compressor 611 to 300 psia, then cooled in aftercooler/condenser 612. Condensed stream 614 is recirculated to phase separator 606. Uncondensed stream 613 is passed to the membrane unit, 615. A hydrocarbon-enriched permeate is withdrawn as stream 616. This stream is mixed with the untreated purge stream 610, and passed as stream 619 to compressor 623, where it is compressed to 300 psia, and thence into recontactor 622. Membrane residue stream 617, is reduced in pressure to match the output of compressor 624, which was assumed to be at 75 psia, and, combined with compressed stream 608, is recirculated as stream 618 to the reformer.

The recontactor section was assumed to operate at −17° C., with incoming streams 605 and 619 being cooled by heat exchange against outgoing streams and by external chilling, for simplicity not shown in the figure. The recontactor produces a reformate product stream, 621, and a hydrogen-enriched purge gas stream, 620.

Two sub-sets of calculations were performed. For the first sub-set, Examples 2–5, it was assumed that the recontacting of purge vapor and raw reformate is a single-stage operation. For the second sub-set, Examples 6–9, it was assumed that the recontacting is carried out in a multistage column.

EXAMPLE 2

A computer calculation was performed to simulate the process shown in FIG. 6 and described above, but without the membrane treatment loop, so that all of purge stream 607 passes to the recontactor as in a prior art process. The purge cut was assumed to be 25%, that is, 75% of stream 604 was assumed to be recirculated to the reformer reactors as stream 608 and 25% was assumed to be sent to the recontactor as stream 607.

The results of the calculations are shown in Table 2. Stream numbers correspond to FIG. 6, without the membrane loop.

TABLE 2

| Component/ Parameter | Stream 602 | Stream 604 | Stream 603 | Stream 607 | Stream 610 | Stream 620 | Stream 621 |
|---|---|---|---|---|---|---|---|
| Molar Flow Rate (lbmol/h) | 7,606 | 7,155 | 361 | 1,431 | 1,431 | 1,335 | 186 |
| Mass Flow Rate (lb/h) | 124,018 | 90,141 | 27,102 | 18,028 | 18,028 | 11,973 | 12,831 |
| Temperature (° C.) | 514 | 10 | 10 | 10 | 10 | −3 | −11 |

TABLE 2-continued

| Component/ Parameter | Stream 602 | Stream 604 | Stream 603 | Stream 607 | Stream 610 | Stream 620 | Stream 621 |
|---|---|---|---|---|---|---|---|
| Pressure (psia) | 75 | 75 | 70 | 70 | 70 | 70 | 70 |
| Component (mol %) | | | | | | | |
| Hydrogen | 72.3 | 76.8 | 0.5 | 76.8 | 76.8 | 82.3 | 0.5 |
| Methane | 3.2 | 3.4 | 0.1 | 3.4 | 3.4 | 3.6 | 0.1 |
| Ethane | 2.5 | 2.6 | 0.6 | 2.6 | 2.6 | 2.7 | 1.0 |
| Propane | 6.6 | 6.7 | 5.2 | 6.7 | 6.7 | 6.0 | 10.5 |
| Butanes | 7.9 | 7.2 | 19.7 | 7.2 | 7.2 | 4.4 | 32.4 |
| $C_5$+ | 7.5 | 3.2 | 73.8 | 3.2 | 3.2 | 0.9 | 55.3 |
| Component (lb/h) | | | | | | | |
| Hydrogen | 11,081 | 11,076 | 3.6 | 2,215 | 2,215 | 2,214 | 2.0 |
| Methane | 3,927 | 3,920 | 5.6 | 784 | 784 | 782 | 3.9 |
| Ethane | 5,692 | 5,617 | 60.0 | 1,123 | 1,123 | 1,083 | 55.9 |
| Propane | 22,048 | 21,008 | 832 | 4,202 | 4,202 | 3,548 | 862 |
| Butanes | 34,874 | 29,723 | 4,120 | 5,944 | 5,944 | 3,455 | 3,519 |
| $C_5$+ | 46,395 | 18,795 | 22,081 | 3,759 | 3,759 | 891 | 8,387 |

Actual Horsepower = 209 + 1,274 hp

EXAMPLE 3

The computer calculations were repeated, this time assuming that the process was carried out exactly as shown in FIG. 6, including the membrane loop. As in Example 2, stream 607 was assumed to be a 25% cut of stream 604. Of purge stream 607, 40% was assumed to be sent for membrane treatment via line 609, and 60% was assumed to be sent through line 610 directly to the recontactor.

Membrane pressure-normalized fluxes were assumed to be as follows, as are typical of a silicone rubber membrane:

| | |
|---|---|
| Hydrogen | $150 \times 10^{-6}$ cm$^3$(STP)/cm$^2$ · sec · cmHg |
| Methane | $200 \times 10^{-6}$ cm$^3$(STP)/cm$^2$ · sec · cmHg |
| Ethane | $480 \times 10^{-6}$ cm$^3$(STP)/cm$^2$ · sec · cmHg |
| Propane | $730 \times 10^{-6}$ cm$^3$(STP)/cm$^2$ · sec · cmHg |
| Butanes | $900 \times 10^{-6}$ cm$^3$(STP)/cm$^2$ · sec · cmHg |
| $C_5$+ | $1{,}100 \times 10^{-6}$ cm$^3$(STP)/cm$^2$ · sec · cmHg |

The results of the calculations are shown in Table 3. The stream numbers correspond to FIG. 6.

TABLE 3

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lb/mol/h) | 7,606 | 7,157 | 366 | 1,789 | 727 | 717.5 | 364 | 353 | 1,305 | 213 |
| Mass Flow Rate (lb/h) | 124,018 | 90,254 | 27,500 | 22,563 | 9,161 | 8,550 | 6,683 | 1,867 | 12,547 | 14,414 |
| Temperature (° C.) | 514 | 10 | 10 | 10 | 10 | 38 | 34 | 34 | −1 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 65.3 | 90.5 | 80.7 | 0.5 |
| Methane | 3.2 | 3.4 | 0.1 | 3.4 | 3.4 | 3.5 | 3.5 | 3.4 | 3.7 | 0.1 |
| Ethane | 2.5 | 2.6 | 0.6 | 2.6 | 2.6 | 2.6 | 3.9 | 1.3 | 3.1 | 1.1 |
| Propane | 6.6 | 6.7 | 5.2 | 6.7 | 6.7 | 6.6 | 10.8 | 2.2 | 6.9 | 11.9 |
| Butanes | 7.9 | 7.2 | 19.7 | 7.2 | 7.2 | 7.0 | 11.7 | 1.9 | 2.8 | 34.8 |
| $C_5$+ | 7.5 | 3.2 | 73.9 | 3.2 | 3.2 | 2.6 | 4.7 | 0.5 | 0.8 | 51.4 |
| Component (lb/h) | | | | | | | | | | |
| Hydrogen | 11,081 | 11,077 | 3.7 | 2,769 | 1,124 | 1,124 | 479 | 644 | 2,123 | 2.3 |
| Methane | 3,927 | 3,290 | 5.6 | 980 | 398 | 397 | 202 | 195 | 781 | 4.6 |
| Ethane | 5,692 | 5,620 | 60.9 | 1,405 | 570 | 567 | 424 | 143 | 1,201 | 72.4 |
| Propane | 22,048 | 1,032 | 845 | 5,258 | 2,135 | 2,094 | 1,744 | 350 | 3,955 | 1,124 |
| Butanes | 24,873 | 9,789 | 4,189 | 7,447 | 3,023 | 2,870 | 2,487 | 383 | 3,640 | 4,317 |
| $C_5$= | 46,395 | 18,803 | 2,395 | 4,702 | 1,909 | 1,497 | 1,346 | 150 | 845 | 8,893 |

Membrane Area = 400 m$^2$
Actual Horsepower = 196 + 646 + 1,641 hp

EXAMPLE 4

The computer calculation of Example 3 was repeated, except that the purge cut was assumed to be 30%, that is, 30% of stream 604 was passed to stream 607 and 70% was returned as stream 608. All other assumptions were as Example 3, including a 60/40 split between streams 610 and 609.

The results of the calculations are shown in Table 4. The stream numbers correspond to FIG. 6.

TABLE 4

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lbmol/h) | 7,606 | 7,159 | 369 | 2,148 | 1,111 | 1,098 | 384 | 714 | 1,283 | 229 |
| Mass Flow Rate (lb/h) | 124,018 | 90,314 | 27,712 | 27,094 | 14,021 | 13,086 | 7,983 | 5,103 | 12,641 | 15,343 |
| Temperature (° C.) | 514 | 10 | 10 | 10 | 10 | 38 | 35 | 35 | −1 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 60.8 | 86.8 | 80.1 | 0.5 |
| Methane | 3.2 | 3.4 | 0.1 | 3.4 | 3.4 | 3.5 | 3.3 | 3.5 | 3.7 | 0.1 |
| Ethane | 2.5 | 2.6 | 0.6 | 2.6 | 2.6 | 2.6 | 4.1 | 1.8 | 3.2 | 1.2 |
| Propane | 6.6 | 6.7 | 5.2 | 6.7 | 6.7 | 6.6 | 12.3 | 3.6 | 7.2 | 12.5 |
| Butanes | 7.9 | 7.2 | 19.6 | 7.2 | 7.2 | 6.9 | 13.6 | 3.2 | 4.9 | 35.6 |
| $C_5$+ | 7.5 | 3.2 | 73.8 | 3.2 | 3.2 | 2.7 | 5.7 | 1.1 | 0.9 | 49.8 |
| Component (lb/h) | | | | | | | | | | |
| Hydrogen | 11,081 | 11,077 | 3.7 | 3,322 | 1,720 | 1,719 | 470 | 1,249 | 2,072 | 2.5 |
| Methane | 3,927 | 3,921 | 5.7 | 1,176 | 609 | 608 | 204 | 404 | 768 | 5.0 |
| Ethane | 5,692 | 5,621 | 61.4 | 1,686 | 873 | 867 | 478 | 389 | 1,227 | 80.5 |
| Propane | 22,048 | 21,045 | 852 | 6,314 | 3,267 | 3,205 | 2,080 | 1,124 | 4,076 | 1,264 |
| Butanes | 24,873 | 29,824 | 4,226 | 8,947 | 4,630 | 4,396 | 3,047 | 1,348 | 3,675 | 4,744 |
| $C_5$+ | 46,395 | 18,825 | 22,562 | 5,647 | 2,923 | 2,291 | 1,702 | 588 | 820 | 9,245 |

Membrane Area = 400 $m^2$
Actual Horsepower = 183 + 989 + 1,628 hp

EXAMPLE 5

The computer calculation of Example 3 was repeated, except that the purge cut was assumed to be 35%, that is, 35% of stream 604 was passed to stream 607 and 65% was returned as stream 608. All other assumptions were as Example 3, including a 60/40 split between streams 610 and 609.

The results of the calculations are shown in Table 5. The stream numbers correspond to FIG. 6.

TABLE 5

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lbmol/h) | 7,606 | 7,160 | 371 | 2,506 | 1,479 | 1,460 | 394 | 1,066 | 1,276 | 238 |
| Mass Flow Rate (lb/h) | 124,018 | 90,372 | 27,914 | 31,630 | 18,662 | 17,415 | 8,688 | 8,727 | 12,720 | 15,915 |
| Temperature (° C.) | 514 | 10 | 10 | 10 | 10 | 38 | 35 | 35 | 0 | −12 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 58.6 | 84.7 | 79.8 | 0.5 |
| Methane | 3.2 | 3.4 | 0.1 | 3.4 | 3.4 | 3.5 | 3.2 | 3.5 | 3.7 | 0.1 |
| Ethane | 2.5 | 2.6 | 0.6 | 2.6 | 2.6 | 2.6 | 4.3 | 2 | 3.2 | 1.2 |
| Propane | 6.6 | 6.7 | 5.2 | 6.7 | 6.7 | 6.9 | 13 | 4.3 | 7.4 | 12.8 |
| Butanes | 7.9 | 7.2 | 19.7 | 7.2 | 7.2 | 6.9 | 14.6 | 4 | 4.9 | 36.1 |
| $C_5$+ | 7.5 | 3.2 | 73.8 | 3.2 | 3.2 | 2.7 | 6.2 | 1.4 | 1.0 | 49.2 |
| Component (lb/h) | | | | | | | | | | |
| Hydrogen | 11,081 | 11,077 | 3.7 | 3,877 | 2,287 | 2,286 | 466 | 1,821 | 2,054 | 2.6 |
| Methane | 3,927 | 394 | 5.7 | 1,372 | 810 | 809 | 205 | 604 | 764 | 5.2 |
| Ethane | 5,692 | 5,623 | 61.81,968 | 1,161 | 1,153 | 504 | 650 | 1,241 | 85.2 | |
| Propane | 2,048 | 1,058 | 859 | 7,370 | 4,348 | 4,265 | 2,255 | 2,010 | 4,146 | 1,345 |

TABLE 5-continued

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Butanes | 4,873 | 9,859 | 4,261 | 10,450 | 6,165 | 5,854 | 3,353 | 2,500 | 3,704 | 4,999 |
| $C_5$+ | 6,395 | 18,834 | 22,722 | 6,591 | 3,889 | 3,048 | 1,905 | 1,143 | 810 | 9,478 |

Membrane Area = 400 $m^2$
Actual Horsepower = 170 + 1,315 + 1,629 hp

EXAMPLE 6

A computer calculation was performed to simulate the prior art, no-membrane case, but this time the recontactor is a seven-stage column, rather than a single-stage contact vessel. For this non-membrane case, as for Example 2, all of purge stream 607 was assumed to pass to the recontactor. All other assumptions were as in Example 2.

The results of the calculations are shown in Table 6. The stream numbers correspond to FIG. 6.

TABLE 6

| Component/ Parameter | Stream 602 | Stream 604 | Stream 603 | Stream 607 | Stream 610 | Stream 620 | Stream 621 |
|---|---|---|---|---|---|---|---|
| Molar Flow Rate (lbmol/h) | 7,606 | 7,155 | 361 | 1,431 | 1,431 | 1,277 | 244 |
| Mass Flow Rate (lb/h) | 124,018 | 90,141 | 27,102 | 18,028 | 18,028 | 8,891 | 15,913 |
| Temperature (° C.) | 950 | 50 | 50 | 50 | 50 | 21 | −15 |
| Pressure (psia) | 75 | 75 | 70 | 70 | 70 | 70 | 70 |
| Component (mol %) | | | | | | | |
| Hydrogen | 72.3 | 76.8 | 0.5 | 76.8 | 76.8 | 86.0 | 0.6 |
| Methane | 3.2 | 3.4 | 0.1 | 3.4 | 3.4 | 3.8 | 0.2 |
| Ethane | 2.5 | 2.6 | 0.6 | 2.6 | 2.6 | 2.7 | 1.4 |
| Propane | 6.6 | 6.7 | 5.2 | 6.7 | 6.7 | 4.8 | 15.9 |
| Butanes | 7.9 | 7.2 | 19.7 | 7.2 | 7.2 | 2.0 | 38.4 |
| $C_5$+ | 7.5 | 3.2 | 73.8 | 3.2 | 3.2 | 0.6 | 43.4 |
| Component (lb/h) | | | | | | | |
| Hydrogen | 11,081 | 11,076 | 3.6 | 2,215 | 2,215 | 2,213 | 2.8 |
| Methane | 3,927 | 3,920 | 5.6 | 784 | 784 | 779 | 6.2 |
| Ethane | 5,692 | 5,617 | 60.0 | 1,123 | 1,123 | 1,033 | 106 |
| Propane | 22,048 | 21,008 | 832 | 4,202 | 4,202 | 2,700 | 1,710 |
| Butanes | 24,873 | 29,724 | 4,120 | 5,945 | 5,945 | 1,508 | 5,460 |
| $C_5$+ | 46,395 | 18,795 | 22,080 | 3,759 | 3,759 | 657 | 8,622 |

Actual Horsepower = 209 + 1,273 hp

EXAMPLE 7

The computer calculations of Example 6 were repeated, this time assuming that the process was carried out exactly as shown in FIG. 6, including the membrane loop. As in Example 6, stream 607 was assumed to be a 25% cut of stream 604. Of purge stream 607, 40% was assumed to be sent for membrane treatment via line 609, and 60% was assumed to be sent through line 610 directly to the recontactor.

Membrane pressure-normalized fluxes were assumed to be as follows, as are typical of a silicone rubber membrane:

| | |
|---|---|
| Hydrogen | $150 \times 10^{-6}$ $cm^3(STP)/cm^2 \cdot sec \cdot cmHg$ |
| Methane | $200 \times 10^{-6}$ $cm^3(STP)/cm^2 \cdot sec \cdot cmHg$ |
| Ethane | $480 \times 10^{-6}$ $cm^3(STP)/cm^2 \cdot sec \cdot cmHg$ |

-continued

| | |
|---|---|
| Propane | $730 \times 10^{-6}$ $cm^3(STP)/cm^2 \cdot sec \cdot cmHg$ |
| Butanes | $900 \times 10^{-6}$ $cm^3(STP)/cm^2 \cdot sec \cdot cmHg$ |
| $C_5$+ | $1,100 \times 10^{-6}$ $cm^3(STP)/cm^2 \cdot sec \cdot cmHg$ |

TABLE 7

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lbmol/h) | 7,606 | 7,158 | 366 | 1,789 | 727 | 717.5 | 364 | 353 | 1,237 | 281 |
| Mass Flow Rate (lb/h) | 124,018 | 90,254 | 27,500 | 22,563 | 9,161 | 8,550 | 6,683 | 1,867 | 9,014 | 17,947 |
| Temperature | 514 | 10 | 10 | 10 | 10 | 38 | 34 | 34 | −3 | −27 |

TABLE 7-continued

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| (° C.) | | | | | | | | | | |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 65.3 | 90.5 | 85.1 | 0.6 |
| Methane | 3.2 | 3.4 | 0.1 | 3.4 | 3.4 | 3.5 | 3.5 | 3.5 | 3.9 | 0.2 |
| Ethane | 2.5 | 2.6 | 0.6 | 2.6 | 2.6 | 2.6 | 3.9 | 1.4 | 3.1 | 1.6 |
| Propane | 6.6 | 6.7 | 5.2 | 6.7 | 6.7 | 6.6 | 10.9 | 2.2 | 5.2 | 17.9 |
| Butanes | 7.9 | 7.2 | 19.7 | 7.2 | 7.2 | 7.0 | 11.7 | 1.9 | 2.0 | 39.7 |
| $C_5$+ | 7.5 | 3.2 | 73.8 | 3.2 | 3.2 | 2.6 | 4.7 | 0.5 | 0.7 | 40.0 |
| Component (lb/h) | | | | | | | | | | |
| Hydrogen | 11,081 | 11,077 | 3.7 | 2,769 | 1,124 | 1,124 | 479 | 644 | 2,122 | 3.2 |
| Methane | 3,927 | 3,921 | 5.6 | 980 | 398 | 397 | 202 | 195 | 778 | 7.4 |
| Ethane | 5,692 | 5,620 | 60.9 | 1,405 | 570 | 567 | 424 | 143 | 1,134 | 139 |
| Propane | 2,048 | 1,032 | 845 | 5,258 | 2,165 | 2,094 | 1,744 | 350 | 2,858 | 2,221 |
| Butanes | 4,873 | 9,790 | 4,189 | 7,447 | 3,024 | 2,870 | 2,487 | 384 | 1,468 | 6,490 |
| $C_5$+ | 6,395 | 18,814 | 2,395 | 4,704 | 1,909 | 1,497 | 1,346 | 151 | 653 | 9,046 |

Membrane Area = 400 $m^2$
Actual Horsepower = 196 + 646 + 1,641 hp

EXAMPLE 8

The computer calculation of Example 7 was repeated, except that the purge cut, stream 607, was assumed to be 30% of stream 604. The feed flow rate, feed stream composition, and all other operating conditions were as in Example 6. Membrane pressure-normalized fluxes were assumed to be as in Example 7.

The results of the calculations are shown in Table 8. The stream numbers correspond to FIG. 6.

EXAMPLE 9

The computer calculation of Example 7 was repeated, except that the purge cut, stream 607, was assumed to be 35% of stream 604. The feed flow rate, feed stream composition, and all other operating conditions were as in Example 6. Membrane pressure-normalized fluxes were assumed to be as in Example 7.

The results of the calculations are shown in Table 9. The stream numbers correspond to FIG. 6.

TABLE 8

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lbmol/h) | 7,606 | 7,159 | 369 | 2,148 | 1,111 | 1,098 | 384 | 714 | 1,212 | 300 |
| Mass Flow Rate (lb/h) | 124,018 | 90,314 | 27,712 | 27,094 | 14,022 | 13,086 | 7,983 | 5,103 | 8,961 | 19,022 |
| Temperature (° C.) | 514 | 10 | 10 | 10 | 10 | 38 | 35 | 35 | −2 | −28 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 60.8 | 86.8 | 84.8 | 0.6 |
| Methane | 3.2 | 3.4 | 0.1 | 3.4 | 3.4 | 3.5 | 3.3 | 3.5 | 3.9 | 0.2 |
| Ethane | 2.5 | 2.6 | 0.6 | 2.6 | 2.6 | 2.6 | 4.1 | 1.8 | 3.2 | 1.7 |
| Propane | 6.6 | 6.7 | 5.2 | 6.7 | 6.7 | 6.6 | 12.3 | 3.6 | 5.4 | 18.6 |
| Butanes | 7.9 | 7.2 | 19.7 | 7.2 | 7.2 | 6.9 | 13.6 | 3.2 | 2.0 | 40.0 |
| $C_5$+ | 7.5 | 3.2 | 73.8 | 3.2 | 3.2 | 2.7 | 0.7 | 1.1 | 0.7 | 38.9 |
| Component (lb/h) | | | | | | | | | | |
| Hydrogen | 11,081 | 11,077 | 3.7 | 3,322 | 1,720 | 1,719 | 470 | 1,249 | 2,071 | 3.4 |
| Methane | 3,927 | 3,921 | 5.7 | 1,176 | 609 | 608 | 204 | 404 | 765 | 8.0 |
| Ethane | 5,692 | 5,621 | 61.4 | 1,686 | 873 | 867 | 478 | 389 | 1,153 | 154 |
| Propane | 22,048 | 21,045 | 852 | 6,314 | 3,267 | 3,205 | 2,080 | 1,124 | 2,880 | 2,460 |
| Butanes | 24,873 | 29,824 | 4,226 | 8,947 | 4,630 | 4,396 | 3,047 | 1,348 | 1,443 | 6,978 |
| $C_5$+ | 46,395 | 18,825 | 22,562 | 5,647 | 2,923 | 2,291 | 1,702 | 588 | 649 | 9,419 |

Membrane Area = 400 $m^2$
Actual Horsepower = 183 + 989 + 1,628 hp

TABLE 9

| Component/ Parameter | Stream 602 | Stream 604 | Stream 603 | Stream 607 | Stream 609 | Stream 613 | Stream 616 | Stream 617 | Stream 620 | Stream 621 |
|---|---|---|---|---|---|---|---|---|---|---|
| Molar Flow Rate (lbmol/h) | 7,606 | 7,160 | 372 | 2,506 | 1,479 | 1,460 | 394 | 1,066 | 1,203 | 311 |
| Mass Flow Rate (lb/h) | 124,018 | 90,372 | 27,914 | 31,630 | 18,662 | 17,415 | 8,688 | 8,727 | 8,960 | 19,675 |
| Temperature (° C.) | 514 | 10 | 10 | 10 | 10 | 38 | 35 | 35 | −1 | −28 |
| Pressure (psia) | 75 | 75 | 70 | 70 | 70 | 300 | 50 | 290 | 70 | 70 |
| Component (mol %) | | | | | | | | | | |
| Hydrogen | 72.3 | 76.8 | 0.5 | 76.8 | 76.8 | 77.7 | 58.6 | 84.7 | 84.6 | 0.6 |
| Methane | 3.2 | 3.4 | 0.1 | 3.4 | 3.4 | 3.5 | 3.2 | 3.5 | 3.9 | 0.2 |
| Ethane | 2.5 | 2.6 | 0.6 | 2.6 | 2.6 | 2.6 | 4.3 | 2.0 | 3.2 | 1.7 |
| Propane | 6.6 | 6.7 | 5.2 | 6.7 | 6.7 | 6.9 | 13.0 | 4.3 | 5.5 | 18.9 |
| Butanes | 7.9 | 7.2 | 19.7 | 7.2 | 7.2 | 6.9 | 14.6 | 4.0 | 2.0 | 30.2 |
| $C_5$+ | 7.5 | 3.2 | 73.8 | 3.2 | 3.2 | 2.7 | 6.2 | 1.4 | 0.7 | 38.4 |
| Component (lb/h) | | | | | | | | | | |
| Hydrogen | 11,081 | 11,077 | 3.7 | 3,877 | 2,287 | 2,286 | 466 | 1,821 | 2,054 | 3.5 |
| Methane | 3,927 | 3,924 | 5.7 | 1,372 | 810 | 809 | 205 | 604 | 761 | 8.3 |
| Ethane | 5,692 | 5,623 | 61.8 | 1,968 | 1,161 | 1,153 | 504 | 650 | 1,163 | 163 |
| Propane | 22,048 | 1,058 | 859 | 7,370 | 4,348 | 4,265 | 2,255 | 2,010 | 2,897 | 2,595 |
| Butanes | 24,873 | 9,859 | 4,261 | 10,450 | 6,165 | 5,854 | 3,353 | 2,500 | 1,438 | 7,265 |
| $C_5$+ | 46,395 | 18,834 | 2,722 | 6,591 | 3,889 | 3,048 | 1,905 | 1,143 | 649 | 9,641 |

Membrane Area = 400 $m^2$
Actual Horsepower = 170 + 1,315 + 1,629 hp

EXAMPLE 10 COMPARISON OF EXAMPLES 2–9

The reformate liquid recovery and the concentration of hydrogen in the hydrogen recycle stream and the fmal purge gas stream were compared for the calculations of Examples 2–9. The results are shown in Table 10.

TABLE 10

| Recontactor Type | Example # | Recycle/Purge Split (mol %) | Total Liquid Product Recovered (Streams 603 + 621) (lb/h) | $H_2$ Concentration in Recycle Stream 618 (mol %) | $H_2$ Concentration in Product Stream 620 (mol %) |
|---|---|---|---|---|---|
| single-stage | 2 (no membrane) | 75/25 | 30,468 | 76.8 | 82.3 |
| | 3 | 75/25 | 31,288 | 77.6 | 80.7 |
| | 4 | 70/30 | 31,807 | 78.0 | 80.1 |
| | 5 | 65/35 | 32,200 | 78.2 | 79.8 |
| multi-stage | 6 (no membrane) | 75/25 | 30,702 | 76.8 | 86.0 |
| | 7 | 75/25 | 31,481 | 77.6 | 85.1 |
| | 8 | 70/30 | 31,976 | 78.0 | 84.8 |
| | 9 | 65/35 | 32,363 | 78.2 | 84.6 |

For all examples of the invention, the percentage split between the portions of the purge treated in the membrane loop and passed untreated to the recontactor was 40/60. As a larger percentage of the first separator overhead stream is purged and passed through the membrane treatment, more total reformate liquid products are produced. For example, taking a purge cut of 25%, and then membrane treating 40% of this, yields 31,288 lb/h of reformate, compared with 30,468 lb/h for the prior art case, an increased yield of 820 lb/h, or over 7 million lb annually. If a higher purge cut is taken, and a multi-stage recontactor is used, the yield can be raised as high as 32,363 lb/h, for an annual increased yield of over 16 million lb.

The addition of the hydrogen-enriched residue stream, 617, to the hydrogen recycle stream, 608, produces a higher hydrogen concentration in the combined recycle stream, 618, being introduced to the reformer. Even very small increases, such as the 0.8–1.4% increase from the 76.8% in stream 608, can be significant in prolonging the life of the reformer catalyst and in reducing the formation of non-preferred, low-value products.

We claim:

1. A catalytic reforming process, comprising the following steps:

(a) catalytically reforming a hydrocarbon feedstock in a reactor;

(b) withdrawing an effluent stream comprising hydrogen and hydrocarbons from the reactor;

(c) separating a raw reformate liquid phase and a vapor phase, comprising hydrogen and light hydrocarbons, including a $C_5^+$ hidrocarbon from the effluent stream;

(d) passing at least a portion of the vapor phase as a feed stream across the feed side of a polymeric membrane having a feed side and permeate side, and being selective for the light hydrocarbon over hydrogen;

(e) withdrawing from the permeate side a permeate stream enriched in the light hydrocarbon compared with the vapor phase;

(f) withdrawing from the feed side a residue stream enriched in hydrogen compared with the vapor phase;

(g) recirculating at least a portion of the residue stream to the reactor.

2. The process of claim 1, wherein the separating step (c) comprises cooling at least a portion of the effluent stream.

3. The process of claim 1, wherein the polymeric membrane comprises silicone rubber.

4. The process of claim 1, wherein the polymeric membrane comprises a super-glassy polymer.

5. The process of claim 1, wherein the light hydrocarbon further comprises methane.

6. The process of claim 1, wherein the light hydrocarbon further comprises a $C_{3+}$ hydrocarbon.

7. The process of claim 1, wherein the permeate stream is subjected to further separation treatment.

8. The process of claim 1, wherein the permeate stream has a hydrocarbon concentration at least about 10% higher than the hydrocarbon concentration of the feed stream.

9. The process of claim 1, wherein the permeate stream has a hydrocarbon concentration at least about 15% higher than the hydrocarbon concentration of the feed stream.

10. The process of claim 1, wherein the residue stream has a hydrogen concentration no more than about 5% higher than the feed stream.

11. The process of claim 1, wherein the residue stream has a hydrogen concentration no more than about 2% higher than the feed stream.

12. The process of claim 1, further comprising the following steps:

(h) passing the permeate stream and a portion of the raw reformate liquid into a contactor;

(i) withdrawing from the contactor a reformate stream enriched in $C_{3+}$ hydrocarbon content compared with the raw reformate liquid;

(j) withdrawing from the contactor a gas stream depleted in $C_{3+}$ hydrocarbon content compared with the permeate stream.

13. The process of claim 12, further comprising compressing the permeate stream before passing it into the contactor.

14. The process of claim 12, wherein the contactor is operated at a temperature no lower than about −10° C.

15. The process of claim 12, wherein the contactor is operated at a temperature no lower than about 0° C.

16. A catalytic reforming process, comprising the following steps:

(a) catalytically reforming a hydrocarbon feedstock in a reactor;

(b) withdrawing an effluent stream comprising hydrogen and hydrocarbons from the reactor;

(c) separating a raw reformate liquid phase and a vapor phase, comprising hydrogen and light hydrocarbons, including including a $C_5^+$ hydrocarbon from the effluent stream;

(d) recirculating a portion of the vapor phase to the reactor;

(e) passing at least a portion of the unrecirculated vapor phase as a feed stream across the feed side of a polymeric membrane having a feed side and permeate side, and being selective for the light hydrocarbon over hydrogen;

(f) withdrawing from the feed side a residue stream enriched in hydrogen compared with the vapor phase;

(g) withdrawing from the permeate side a permeate stream enriched in the light hydrocarbon compared with the vapor phase;

(h) passing the permeate stream and a portion of the raw reformate liquid into a contactor;

(i) withdrawing from the contactor a reformate stream enriched in $C_{3+}$ hydrocarbon content compared with the raw reformate liquid;

(j) withdrawing from the contactor a gas stream depleted in $C_{3+}$ hydrocarbon content compared with the permeate stream.

17. The process of claim 16, wherein the separating step (c) comprises cooling at least a portion of the effluent stream.

18. The process of claim 16, wherein the polymeric membrane comprises silicone rubber.

19. The process of claim 16, wherein the polymeric membrane comprises a super-glassy polymer.

20. The process of claim 16, wherein the light hydrocarbon further comprises methane.

21. The process of claim 16, wherein the light hydrocarbon further comprises a $C_{3+}$ hydrocarbon.

22. The process of claim 16, wherein the permeate stream has a hydrocarbon concentration at least about 10% higher than the hydrocarbon concentration of the feed stream.

23. The process of claim 16, wherein the permeate stream has a hydrocarbon concentration at least about 15% higher than the hydrocarbon concentration of the feed stream.

24. The process of claim 16, wherein the residue stream has a hydrogen concentration no more than about 5% higher than the feed stream.

25. The process of claim 16, wherein the residue stream has a hydrogen concentration no more than about 2% higher than the feed stream.

26. The process of claim 16, further comprising compressing the permeate stream before passing it into the contactor.

27. The process of claim 16, wherein the contactor is operated at a temperature no lower than about −10° C.

28. The process of claim 16, wherein the contactor is operated at a temperature no lower than about 0° C.

29. The process of claim 16, wherein the contactor comprises an absorption column.

30. The process of claim 16, further comprising compressing the feed stream prior to passing the feed stream across the feed side.

31. The process of claim 30, wherein the compressing results in condensation of a liquid hydrocarbon fraction and wherein the liquid hydrocarbon fraction is removed from the feed stream prior to passing the feed stream across the feed side.

32. The process of claim 16, further comprising recirculating at least a portion of the residue stream to the reactor.

33. A process for treating effluent from a catalytic reformer reactor, comprising the following steps:

(a) withdrawing an effluent stream comprising hydrogen and hydrocarbons from the reactor;

(b) separating a raw reformate liquid phase and a vapor phase, comprising hydrogen and light hydrocarbons, including a $C_{5+}$ hydrocarbon, from the effluent stream;

(c) recirculating a portion of the vapor phase to the reactor;

(d) passing at least a portion of the unrecirculated vapor phase and at least a portion of the raw reformate liquid into a contactor;

(e) withdrawing from the contactor a refonmate stream enriched in $C_{3+}$ hydrocarbon content compared with the raw reformate liquid;

(f) withdrawing from the contactor a gas stream including a $C_{5+}$ hydrocarbon and depleted in $C_{3+}$ hydrocarbon content compared with the unrecirculated vapor phase;

(g) passing at least a portion of the gas stream as a feed stream across the feed side of a polymeric membrane having a feed side and permeate side, and being selective for the $C_{5+}$ hydrocarbon over hydrogen;

(h) withdrawing from the feed side a residue stream enriched in hydrogen compared with the feed stream;

(i) withdrawing from the permeate side a permeate stream enriched in the $C_{5+}$ hydrocarbon compared with the feed stream.

34. The process of claim 33, further comprising the following steps:

(j) compressing and cooling the permeate stream, thereby forming a condensate and an uncondensed portion;

(k) passing the condensate into the contactor with the raw reformate liquid;

(l) passing the uncondensed portion into the contactor with the unrecirculated vapor phase.

35. The process of claim 33, further comprising recirculating at least a portion of the residue stream to the reactor.

36. A catalytic reforming process, comprising the following steps:

(a) catalytically reforming a hydrocarbon feedstock in a reactor;

(b) withdrawing an effluent stream comprising hydrogen and hydrocarbons from the reactor;

(c) separating a raw refonnate liquid phase and a vapor phase, comprising hydrogen and a light hydrocarbon, from the effluent stream;

(d) passing at least a portion of the vapor phase as a feed stream across the feed side of a polymeric membrane having a feed side and permeate side, and being selective for the light hydrocarbon over hydrogen;

(e) withdrawing from the permeate side a permeate stream enriched in the light hydrocarbon compared with the vapor phase, the permeate stream having a hydrocarbon concentration at least about 5% higher than the hydrocarbon concentration of the feed stream;

(f) withdrawing from the feed side a residue stream enriched in hydrogen compared with the vapor phase;

(g) recirculating at least a portion of the residue stream to the reactor.

37. A catalytic reforming process, comprising the following steps;

(a) catalytically reforming a hydrocarbon feedstock in a reactor;

(b) withdrawing an effluent stream comprising hydrogen and hydrocarbons from the reactor;

(c) separating a raw reformate liquid phase and a vapor phase, comprising hydrogen and a light hydrocarbon, from the effluent stream;

(d) recirculating a portion of the vapor phase to the reactor;

(e) passing at least a portion of the unrecirculated vapor phase as a feed stream across the feed side of a polymeric membrane having a feed side and permeate side, and being selective for the light hydrocarbon over hydrogen;

(f) withdrawing from the feed side a residue stream enriched in hydrogen compared with the vapor phase;

(g) withdrawing from the permeate side a permeate stream enriched in the light hydrocarbon compared with the vapor phase, the permeate stream having a hydrocarbon concentration at least about 5% higher than the hydrocarbon concentration of the feed steam;

(h) passing the permeate stream and a portion of the raw reformate liquid into a contactor;

(i) withdrawing from the contactor a reformate stream enriched in $C_{3+}$ hydrocarbon content compared with the raw reformate liquid;

(j) withdrawing from the contactor a gas stream depleted in $C_{3+}$ hydrocarbon content compared with the permeate stream.

38. A process for treating effluent from a catalytic reformer reactor, comprising the following steps:

(a) withdrawing an effluent stream comprising hydrogen and hydrocarbons from the reactor;

(b) separating a raw reformate liquid phase and a vapor phase, comprising hydrogen and a light hydrocarbon, from the effluent stream;

(c) recirculating a portion of the vapor phase to the reactor;

(d) passing at least a portion of the unrecirculated vapor phase and at least a portion of the raw reformate liquid into a contactor;

(e) withdrawing from the contactor a reformate stream enriched in $CC_{3+}$ hydrocarbon content compared with the raw reformate liquid;

(f) withdrawing from the contactor a gas stream depleted in $C_{3+}$ hydrocarbon content compared with the unrecirculated vapor phase;

(g) passing at least a portion of the gas stream as a feed stream across the feed side of a polymeric membrane having a feed side and permeate side, and being selective for the light hydrocarbon over hydrogen;

(h) withdrawing from the feed side a residue stream enriched in hydrogen compared with the feed stream;

(i) withdrawing from the permeate side a permeate stream enriched in the light hydrocarbon compared with the feed stream, the permeate stream having a hydrocarbon concentration at least about 5% higher than the hydrocarbon concentration of the feed stream.

* * * * *